US007042305B2

(12) United States Patent
Wray

(10) Patent No.: US 7,042,305 B2
(45) Date of Patent: May 9, 2006

(54) TRANSMISSION LINE TERMINATION

(75) Inventor: Gordon Thomas Wray, Kitchener (CA)

(73) Assignee: Com Dev Ltd., Cambridge (CA)

( * ) Notice: Subject to any disclaimer, the term of this patent is extended or adjusted under 35 U.S.C. 154(b) by 0 days.

(21) Appl. No.: 10/323,825

(22) Filed: Dec. 20, 2002

(65) Prior Publication Data

US 2004/0119551 A1 Jun. 24, 2004

(51) Int. Cl.
*H01P 1/26* (2006.01)

(52) U.S. Cl. ..... 333/22 R

(58) Field of Classification Search ..... 333/22 R
See application file for complete search history.

(56) References Cited

U.S. PATENT DOCUMENTS

| | | | | |
|---|---|---|---|---|
| 2,443,109 | A | 6/1948 | Linder | |
| 2,622,152 | A | 12/1952 | Rosch | |
| 2,909,736 | A | 10/1959 | Sommers et al. | |
| 3,209,284 | A | 9/1965 | Hast | |
| 3,509,495 | A | 4/1970 | Morton | |
| 3,564,464 | A | 2/1971 | Hancock et al. | |
| 3,585,533 | A | 6/1971 | Denhard | |
| 3,654,573 | A | 4/1972 | Graham | |
| 3,790,904 | A | 2/1974 | Lesyk et al. | |
| 3,996,534 | A | 12/1976 | Bacher | |
| 4,024,478 | A | 5/1977 | Wolfe | |
| 4,267,531 | A | 5/1981 | Spinner et al. | |
| 4,647,877 | A | 3/1987 | Thompson | |
| 4,777,456 | A | 10/1988 | Andrikian et al. | |
| 4,879,562 | A * | 11/1989 | Stern et al. | 343/700 MS |
| 4,906,952 | A | 3/1990 | Praba et al. | |
| 5,047,737 | A | 9/1991 | Oldfield | |
| 5,055,806 | A | 10/1991 | Hansen et al. | |
| 5,523,727 | A | 6/1996 | Shingyoji | |
| 5,610,562 | A | 3/1997 | Geissler et al. | |
| 5,670,917 | A | 9/1997 | Mazzochette | |
| 5,801,598 | A | 9/1998 | Tantawi et al. | |
| 5,831,491 | A | 11/1998 | Buer et al. | |
| 6,016,085 | A * | 1/2000 | Mazzochette | 333/22 R |
| 6,705,388 | B1 * | 3/2004 | Sorgo | 165/80.3 |

FOREIGN PATENT DOCUMENTS

| | | |
|---|---|---|
| DE | 1 077 275 | 3/1960 |
| DE | 1 083 365 | 6/1960 |
| FR | 2 234 833 | 1/1975 |
| GB | 1 490 861 | 11/1977 |
| JP | 58069101 | 4/1983 |
| JP | 61173502 | 8/1986 |

OTHER PUBLICATIONS

Barry Industries, Inc. brochure, Attelboro, MA, 1995.

Suetake ET AL., "Microwave Applications of Thin Magnetic Resistive Sheets", 1977 International Microwave Symposium Digest, San Diego, CA, USA, pp. 21 to 23, Jun. 1977.

* cited by examiner

*Primary Examiner*—Stephen E. Jones
(74) *Attorney, Agent, or Firm*—Bereskin & Parr

(57) ABSTRACT

A termination for absorbing electromagnetic energy provided by a transmission line and for transferring any resulting heat to a heat sink. The termination comprises a housing in communication with the transmission line for receiving the electromagnetic energy, and in communication with the heat sink for transferring the resulting heat thereto. The termination also includes a conductor disposed within the housing and cooperating with the housing for providing an internal transmission line structure for confining and guiding the electromagnetic energy within the termination. The termination also includes an absorber comprising a lossy dielectric. The absorber is disposed within the housing and is in communication with the internal transmission line for receiving the electromagnetic energy and absorbing the electromagnetic energy in accordance to an absorption profile of the termination. The absorber converts the absorbed energy into heat and is in communication with the housing for transferring the heat thereto.

90 Claims, 17 Drawing Sheets

TRANSMISSION LINE TERMINATION

FIELD OF THE INVENTION

The present invention relates to a transmission line termination for absorbing electromagnetic energy and for transferring the resulting heat away from the device. The invention is directed towards creating a compact termination with improved thermal performance and a flexible configuration that can be adjusted by the designer to meet various design constraints.

BACKGROUND OF THE INVENTION

High frequency electronic circuits, such as RF circuits or microwave circuits, comprise a number of electrical devices that are connected together by a transmission line structure that routes high frequency electrical signals to each device. The transmission line structure may take a variety of forms such as, but not limited to, coaxial, waveguide, stripline and microstrip transmission lines. Many other transmission line structures are possible and well known to those skilled in the art. Useful texts on this subject include "Field Theory of Guided Waves", IEEE Press, ©1991 by R. E. Collin; "Microwave Engineers' Handbook", Artech House, ©1971 compiled and edited by T. S. Saad; and "Microwave Filters, Impedance Matching Networks, and Coupling Structures", McGraw-Hill, ©1964, by G. L. Matthaei, L. Young, and E. M. T. Jones.Each transmission line structure usually consists of metallic conductors and a low-loss dielectric.

The electrical devices in the high frequency circuits may be, for example, a filter or a circulator and the like. These electrical devices generally extract a desired signal from an electrical signal and routes the energy corresponding to this desired signal to a transmission line. However, many circumstances may cause a reflection of the energy back to the electrical device from where it came which may damage the electrical device. These circumstances include impedance mismatch, faulty components, incorrect switch settings, or improper operating frequency. To prevent damage, high frequency electronic circuits incorporate electrical devices called terminations to absorb unwanted electromagnetic energy. The absorbed electromagnetic energy is converted to heat. To be effective, these terminations must provide adequate power absorption and reflect incoming electromagnetic energy as little as possible. This requires any impedance discontinuity between a transmission line structure and a termination to be small.

The terminations must also be able to transfer the heat generated by a termination due to energy absorption from the termination to the environment to ensure that the total absorbed energy will not produce excessive temperatures within the termination. In general, there are three methods for removing heat from the termination: convection, radiation, and conduction. For many applications, such as a space environment, convection and radiation are ineffective leaving conduction as the only effective method of heat removal. For heat to be removed by conduction, the termination must be mounted to a thermally conductive surface. The portion of the environment that accepts the transferred heat is known as a heat sink. The heat sink may be a surface exposed to a cooling fluid such as water or moving air. However, where conduction dominates, the heat sink consists of the thermally conductive surface.

The thermal design of the termination now involves effectively transferring the heat from the absorber to the heat sink in order to minimize the temperature rise within the termination. A large temperature rise within the termination may cause physical damage to the materials of the termination. Furthermore, the performance of the termination deteriorates as the temperature sensitive components within the termination reach ever higher temperatures.

The high temperatures can be mitigated by increasing the size of the termination. However, in some applications such as space, the components may have size limitations. The heat generated by a termination also produces a high temperature in the vicinity of the termination that, in many applications, can seriously complicate the thermal design of nearby components. Consequently, terminations are frequently located remotely from its associated equipment and connected by coaxial transmission lines.

Current terminations with a coaxial interface include resistive film chip terminations and absorptive terminations. Resistive film chip terminations are mainly used with microstrip transmission line structures. Resistive film chip terminations comprise a thin resistive film that is deposited onto a thermally conductive dielectric that is usually mounted on a copper carrier. The electromagnetic energy is provided to the resistive film, which heats up thereby dissipating the electromagnetic energy. However, the generated heat is concentrated in a small area, which creates a high thermal flux density and a high thermal stress on the resistive film. Furthermore, there are multiple interfaces, which creates a long thermal path to the mounting surface that acts as a heat sink for the resistive film chip termination. Consequently, a high internal temperature develops, which affects the structural integrity of the resistive film.

To reduce the temperature within the resistive film chip termination, the area of the resistive film may be increased, or the thickness of the thermally conductive dielectric may be reduced. However, this increases the capacitance of the resistive film chip, which adversely affects performance at microwave frequencies and limits the usefulness of resistive film chip terminations in high power applications. Alternatively, a "distributed" termination may be created using multiple resistive film chip terminations connected by a power splitting network. However, such a distributed termination is complicated, less reliable, and physically large.

In absorptive terminations, the dissipation of the electromagnetic energy occurs in a lossy dielectric material, which absorbs the electromagnetic energy. The absorbed electromagnetic energy is converted to heat. Examples of lossy dielectric materials that are used in current absorptive terminations include'silicon carbide or an epoxy loaded with an iron powder. Absorptive terminations are more effective than resistive film chip terminations for higher power applications since they can be designed to have a lower thermal flux density.

However, prior art absorptive terminations have a somewhat inflexible design. The coaxial structure limits the ability to spread the heat since adjusting the absorption within the termination requires component geometries that are complicated to fabricate and assemble. In addition, prior art absorptive terminations generate heat that is some distance away from the mounting surface that provides a heat sink for dissipating the generated heat. This long thermal path leads to higher internal temperatures within the termination.

SUMMARY OF THE INVENTION

In a first aspect, the present invention provides a termination for absorbing electromagnetic energy provided by a transmission line structure and for transferring any resulting heat to a heat sink. The termination comprises a housing in communication with the transmission line for receiving the electromagnetic energy and in communication with the heat sink for transferring the resulting heat thereto. The termination also includes a conductor disposed within the housing that cooperates with the housing to provide an internal transmission line structure for confining and guiding the electromagnetic energy within the termination. The termination also has an absorber comprising a lossy dielectric that is disposed within the housing and is in communication with the internal transmission line for receiving the electromagnetic energy, absorbing the electromagnetic energy in accordance with an absorption profile of the termination, and converting the absorbed electromagnetic energy into heat. The absorber is in communication with the housing for transferring the resulting heat thereto. The absorber has a first surface, a second surface and other surfaces, the first surface being adjacent to the conductor and the second surface being adjacent to the housing. The first and second surfaces have a large surface area relative to the other surfaces of the absorber and define a low thermal resistance path therebetween for improved transfer of the resulting heat away from the absorber.

In a second aspect, the present invention provides a termination for absorbing electromagnetic energy provided by a transmission line structure and for transferring the resulting heat to a heat sink. The termination has a housing in communication with the transmission line for receiving the electromagnetic energy and in communication with the heat sink for transferring the resulting heat thereto. The termination also has a conductor disposed within the housing and cooperating with the housing for providing an internal transmission line structure for confining and guiding the electromagnetic energy within the termination. The termination also has an absorber comprising a lossy dielectric. The absorber is disposed within the housing and is in communication with the internal transmission line for receiving the electromagnetic energy, absorbing the electromagnetic energy according to an absorption profile of the termination, and converting the absorbed electromagnetic energy into heat. The absorber is in communication with the housing for transferring the resulting heat thereto. The conductor has a narrow width in a first region where the incoming electromagnetic energy is at full strength and a greater width in a second region where the incoming electromagnetic energy is lower due to the absorption in the first region for increasing the amount of absorption in said second region.

In another aspect, the present invention provides a termination for absorbing electromagnetic energy provided by a transmission line and for transferring any resulting heat to a heat sink. The termination comprises a housing in communication with the transmission line for receiving the electromagnetic energy, and in communication with the heat sink for transferring the resulting heat thereto. The termination also includes a conductor disposed within the housing and cooperating with the housing for providing an internal transmission line structure for confining and guiding the electromagnetic energy within the termination. The termination also has a composite absorber being disposed within the housing and being in communication with the internal transmission line for receiving the electromagnetic energy, absorbing the electromagnetic energy according to an absorption profile of the termination, and converting the absorbed electromagnetic energy into heat. The absorber is in communication with the housing for transferring the resulting heat thereto. The composite absorber comprises a lossy dielectric and a low-loss dielectric. The lossy dielectric is disposed adjacent to the housing and the low-loss dielectric is adapted for increasing the lateral spread of the electromagnetic energy through the absorber in a direction transverse to the propagation of the electromagnetic energy for creating a more uniform absorption profile in the termination.

In another aspect, the present invention provides a termination for absorbing electromagnetic provided by a transmission line and for transferring any resulting heat to a heat sink. The termination comprises a housing in communication with the transmission line for receiving the electromagnetic energy, and in communication with the heat sink for transferring the resulting heat thereto. The termination also includes a conductor disposed within the housing and cooperating with the housing for providing an internal transmission line structure for confining and guiding the electromagnetic energy within the termination. The termination also has an absorber comprising a lossy dielectric. The absorber is disposed within the housing and being in communication with the internal transmission line for receiving the electromagnetic energy, absorbing the electromagnetic energy according to an absorption profile of the termination, and converting the absorbed electromagnetic energy into heat. The absorber is in communication with the housing for transferring the resulting heat thereto. At least a portion of the conductor has at least two branches spaced apart from each other for increasing the spread of the electromagnetic energy through the absorber for creating a more uniform absorption profile in the termination.

BRIEF DESCRIPTION OF THE DRAWINGS

For a better understanding of the invention and to show more clearly how it may be carried into effect, reference will now be made, by way of example only, to the accompanying drawings which show prior art terminations and preferred embodiments of the invention and in which.

DETAILED DESCRIPTION OF THE INVENTION

The examples shown herein are offered by way of illustration only and not by way of limitation. Furthermore, the term absorber is used herein to refer to an embodiment of an absorption material suitable for use in a termination that is connected to a transmission line structure. In addition, the Figures shown herein are not necessarily drawn to scale.

Figure 1A:
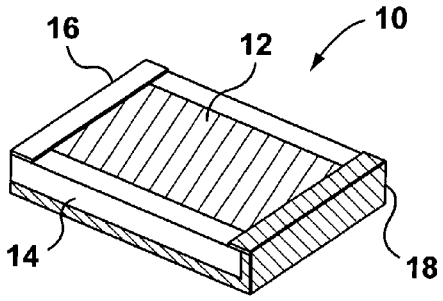
FIG. 1a (Prior Art)
FIG. 1*a* is an isometric view of a prior art resistive film chip.
Figure 1B:
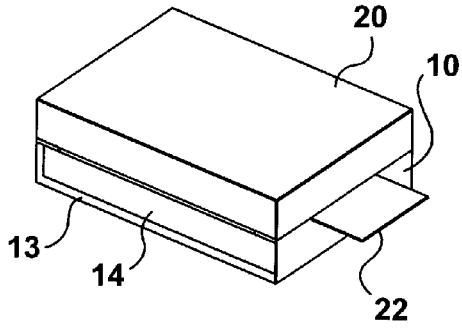
FIG. 1b (Prior Art)
FIG. 1*b* is an isometric view of the prior art resistive film chip of FIG. 1*a* with a protective cover.
Figure 1C:
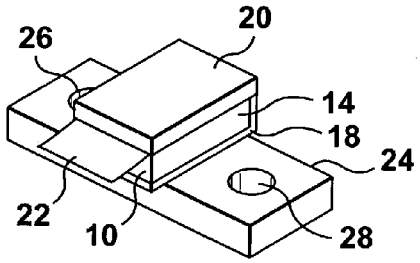
FIG. 1c (Prior Art)
FIG. 1*c* is an isometric view of the prior art resistive film chip of FIG. 1*b* mounted on a copper carrier.

Referring now to FIGS. 1*a*–1*c*, shown therein is a prior art resistive film chip 10 (see FIG. 1*a*) that may be used in a termination. The resistive film chip 10 comprises a thin resistive film 12 that is deposited on a thermally conductive dielectric 14. The dielectric 14 may be chosen from a variety of materials including beryllia, aluminum nitride or alumina. The resistive film chip 10 further comprises a first electrical terminal 16 which acts as an input terminal for the resistive film chip 10 and a second electrical terminal 18 which provides a ground for the resistive film chip 10. To prepare the resistive film chip 10 for use in a termination, the resistive film chip 10 is covered by a protective cap 20 (see FIG. 1*b*). An electrical lead 22 is then attached to the first electrical terminal 16 and the resistive film chip 10 is mounted onto a copper carrier 24 (see FIG. 1*c*). The copper carrier 24 has two holes 26 and 28 which are used to secure the copper carrier 24 to the housing of a termination.

Figure 1D:
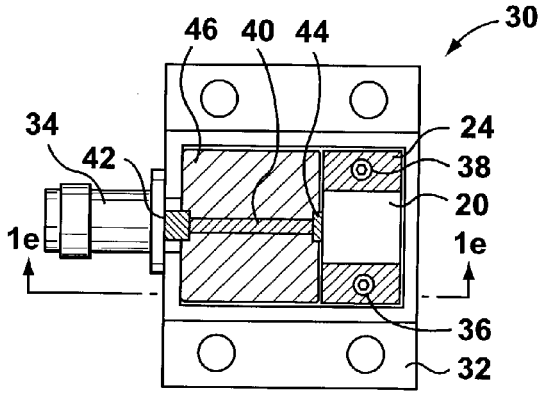
FIG. 1d (Prior Art)
FIG. 1*d* is a top view of a prior art termination employing the resistive film chip of FIG. 1*c* with the lid of the termination removed.
Figure 1E:
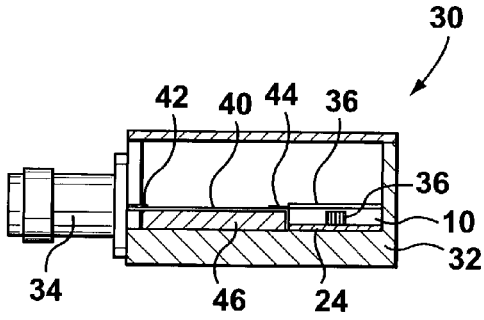
FIG. 1e (Prior Art)
FIG. 1*e* is a partial cross-sectional side view of the prior art termination of FIG. 1*d;*

Referring now to FIGS. 1*d* and 1*e*, shown therein is a prior art resistive film chip termination 30 incorporating the resistive film chip 10 (see FIG. 1*e*) and adapted for connection to a coaxial transmission line (not shown). The resistive film chip termination 30 comprises a metallic housing 32 for providing a support structure for the resistive film chip 10, and a coaxial connector 34 attached to the housing 32 for providing a connection between the resistive film chip termination 30 and the coaxial transmission line. The resistive film chip 10, mounted on the copper carrier 24, is placed at the rear of the termination 30 on the upper surface of the bottom of the housing 32. The copper carrier 24 is secured to the housing 32 via fasteners 36 and 38. The termination 30 also comprises a conductor 40, which guides electromagnetic energy from the coaxial conductor 34 to the resistive film chip 10. Accordingly, the conductor 40 has a first connection region 42 to provide an electrical connection between the coaxial connector 34 and the conductor 40 and a second connection region 44 to provide an electrical connection between the conductor 40 and the resistive film chip 10. The first and second connection regions 42 and 44 overlap the conductor 40 and may be soldered to the conductor 40. A dielectric 46 is placed between the conductor 40 and the bottom of the housing 32 to provide mechanical support.

As mentioned previously, the heat produced by the ohmic dissipation of the electromagnetic energy is concentrated in the small area of the resistive film 12. This heat must cross the resistive film 12, the dielectric 14, the copper carrier 24 and the housing 32 to reach the mounting surface upon which the termination 30 is mounted. This long thermal path and the concentration of heat in the small area of the resistive film chip 10 results in a high internal temperature within the resistive film chip 10.

Figure 2A:
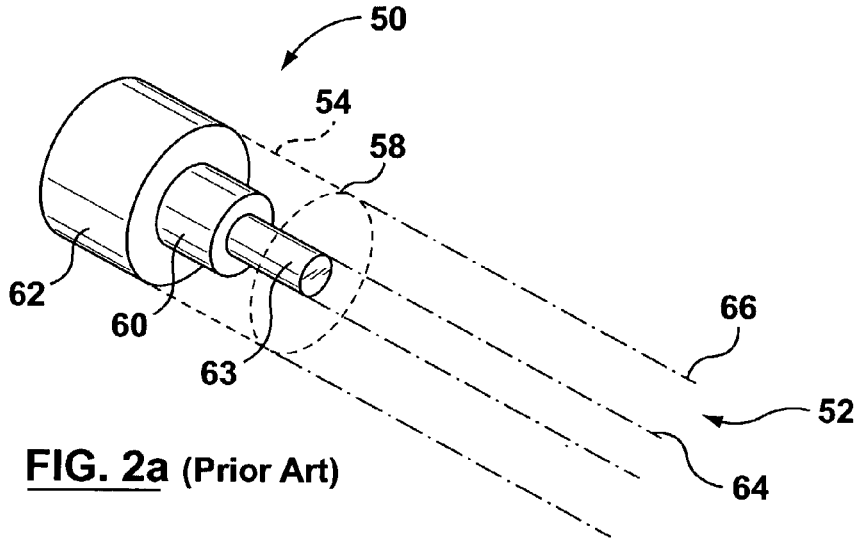
FIG. 2a (Prior Art)
FIG. 2*a* is an isometric view of a prior art step tapered absorptive termination for use in a coaxial transmission line.

Referring now to FIG. 2*a*, shown therein is a prior art step-tapered absorptive termination 50 that is suitable for use with a coaxial transmission line 52 (shown in dash-dotted lines). The termination 50 has a junction 58 for connecting the termination 50 to the coaxial transmission line 52 to receive electromagnetic energy therefrom and a housing 54 (shown in dashed lines) that extends from the junction 58 to the rear of the termination and covers the end. The termination 50 further comprises a first region 60 and a second region 62 with region 60 being disposed in front of region 62. The coaxial transmission line 52 has a center conductor 64 and an outer conductor 66 that acts as a ground. The termination 50 has a conductor 63 that is connected to the center conductor 64. Each region 60 and 62 presents an impedance mismatch, which causes a reflection of the incident electromagnetic energy. The two regions 60 and 62 are configured such that the two reflections cancel each other. Accordingly, the first region 60 provides an impedance transformation between the second region 62 and the coaxial transmission line 52. However, variation in material properties and the dimensions of the two regions 60 and 62 affect the ability of the two reflected waves to exactly cancel which consequently affects the performance of the termination 50. Furthermore, the termination 50 has a narrower frequency response (i.e. electromagnetic energy in only a restricted frequency range can be absorbed) due to the use of step-transition between the regions 60 and 62. The housing 54 acts as a heat sink. Accordingly, the heat that is generated in the first region 60 has a long thermal path to the heat sink.

Figure 2B:
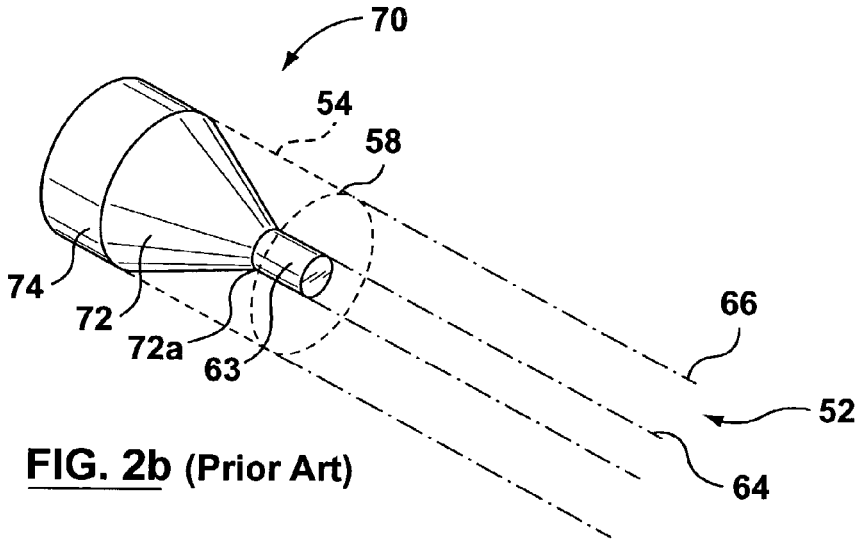
FIG. 2b (Prior Art)
FIG. 2*b* is an isometric view of a prior art conically-tapered absorptive termination for use in a coaxial transmission line.

Referring now to FIG. 2*b*, shown therein is a prior art conically-tapered absorptive termination 70 that is suitable for use with a coaxial transmission line 52. The termination 50 has a junction 58 for connecting the termination 50 to the coaxial transmission line 52 to receive electromagnetic energy therefrom and a housing 54 (shown in dashed lines) that extends from the junction 58 to the rear of the termination and covers the end. The termination 70 further comprises a conically tapered region 72 and a base region 74. The conically tapered region 72 introduces a gradual impedance transition between the coaxial transmission line 52 and the fully filled rear region 74 since the incident electromagnetic energy first meets the pointed edge 72*a* of the termination 70 which presents a small cross-section and produces little mismatch. When linear tapers are used, the dimensions are not as critical as in the case of step-tapered absorptive terminations and performance is reasonably insensitive to magnetic and dielectric properties. However, a sufficiently long taper must be used for adequate absorption and reduction of impedance mismatch, which may result in an unduly lengthy termination for high power applications. Furthermore, in a similar fashion to the termination 50, the heat that is generated within the conically-tapered region 72 has a long thermal path to the housing 54 which acts as a heat sink.

Figure 2C:
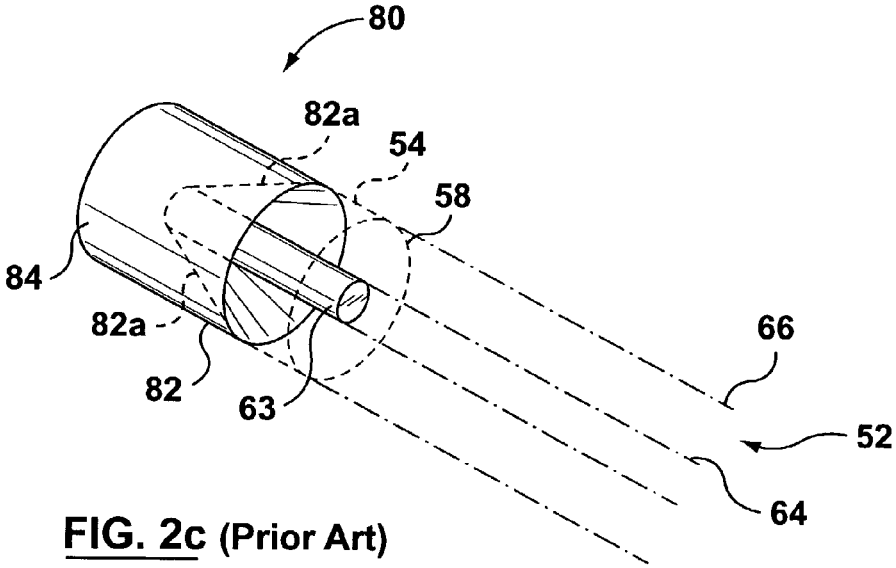
FIG. 2c (Prior Art)
FIG. 2*c* is an isometric view of a prior art inverse conically-tapered absorptive termination for use in a coaxial transmission line.

Referring now to FIG. 2*c*, shown therein is an example of an inverted conically-tapered absorptive termination 80 for use with the coaxial transmission line 52. The termination 50 has a junction 58 for connecting the termination 50 to the coaxial transmission line 52 to receive electromagnetic energy therefrom and a housing 54 (shown in dashed lines) that extends from the junction 58 to the rear of the termination and covers the end. The termination 80 further comprises an inverted conically-tapered region 82 and a base region 84. The inverted conically-tapered region 82 (with the taper shown by dashed lines 82*a*) is used for reducing the impedance mismatch between the termination 80 and the coaxial transmission line 52 while the base region 84 is used to increase the amount of electromagnetic energy that is absorbed by the absorptive termination 80. In contrast with the previous two designs, the absorber 82 near the front of the termination 58 is in intimate contact with the housing 54 thereby providing good thermal transfer. However, the absorber 82 is more difficult to machine, especially for high-thermal-conductivity ceramic materials.

The space around the frontal portions 60 and 72 of the terminations 50 and 70, as well as the space within the frontal portion 82 of the termination 80 is occupied by a dielectric which may be teflon™, air, vacuum or some other dielectric. It is often the same material as that which supports the center conductor 64 in the attached coaxial transmission line 52. This helps to facilitate an impedance match between the terminations 50, 70 and 80 and the coaxial transmission line 52. However, the dielectric may be a different material chosen to accomplish some other purpose. For example, boron nitride may be used to facilitate heat transfer and the geometry of the termination may be adjusted to retain an adequate impedance match.

Figure 3A:
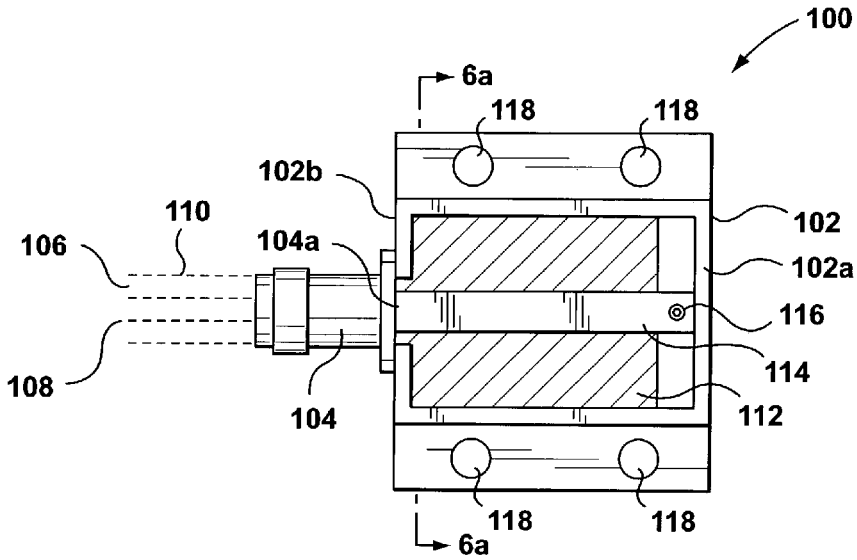
FIG. 3*a* is a partial cross-sectional top view of a termination in accordance with the present invention.
Figure 3B:
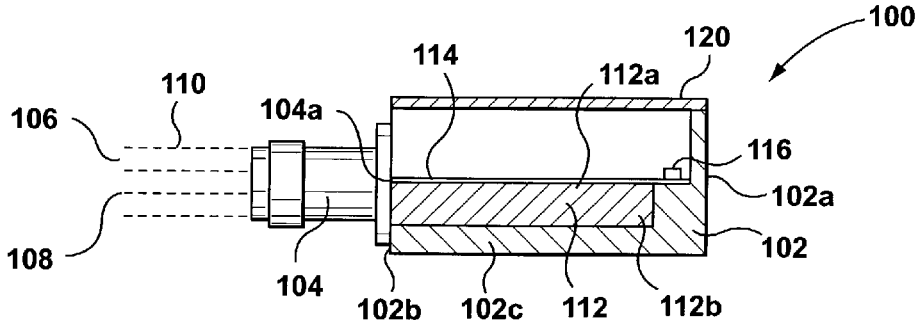
FIG. 3*b* is a partial cross-sectional side view of the termination of FIG. 3*a;*

Referring now to FIGS. 3*a*–3*b*, shown therein is a termination 100 for absorbing electromagnetic energy provided by a transmission line structure in accordance with the present invention. The termination 100 comprises a housing 102 and a connector 104 that is attached to the housing 102. The connector 104 provides a port for transferring electromagnetic energy between the termination 100 and a transmission line structure which provides electromagnetic energy to the termination 100. It should be understood that for the terminations described herein, each termination has a connector at a junction that provides a port for receiving electromagnetic energy from a transmission line structure. In this case, the transmission line structure is a coaxial transmission line 106 (shown by the dotted lines) having an inner conductor 108 and an outer conductor 110. The housing 102 is made from an electrically conductive and highly thermally conductive material. The housing 102 provides mechanical strength for the termination 100 as well as electromagnetic shielding. The housing 102 also confines the incoming electromagnetic energy within the termination 100 and provides the ground plane for an internal transmission line structure for guiding electromagnetic energy within the termination 100. The housing 102 also protects the inner components of the termination 100 from moisture, dust, and other environmental contaminants. The connector 104 may be selected from a variety of coaxial connectors including SMA, BNC, TNC and N connectors. The choice of a specific connector is established by the system designer and is based on the frequency range of operation and the amount of power that the termination 100 will receive.

The termination 100 further comprises an absorber 112 that is disposed within the housing 102 for absorbing the electromagnetic energy that is provided by the coaxial transmission line 106. The termination 100 further comprises a conductor 114 that is disposed within the housing 102 for guiding the electromagnetic energy that is received from the connector 104 along the absorber 112 into which the electromagnetic energy penetrates. The electromagnetic energy is transferred to the absorber 112 along the entire length of the conductor 114. Accordingly, enlarging the conductor 114 by widening or lengthening the conductor 114, will allow more electromagnetic energy to be transferred to the absorber 112 for absorption.

The conductor 114 is attached to the rear 102*a* of the housing 102 via a fastener 116 which may be a screw or the like. Accordingly, the conductor 114 is short circuited to the housing 102, which acts as a ground, so that any incoming electromagnetic energy that is not absorbed by the absorber 112 in the forward propagation direction, will be reflected at the rear 102*a* of the termination 100 and pass once more through the absorber 112 and be absorbed in the reverse propagation direction. Alternatively, the conductor 114 may be terminated in an open-circuit fashion by preventing an electrical connection at the rear of the termination 102*a*.

The conductor 114 is attached to the center conductor 104*a* of the connector 104 at the front 102*b* of the housing 102 via a solder joint (not shown). Alternatively, the conductor 114 may be attached to the front 102*b* of the housing 102 via a slip joint or laser welding. In this case of a slip joint, a pin(not shown) is soldered to the conductor 114 and then inserted into a socket (not shown) in the connector 104. When the conductor 114 is experiencing tension due to the different expansions of various parts of the termination 100 due to a temperature change, the pin will slide within the socket to provide stress relief but electrical contact will always be maintained. The conductor 114 also allows a number of design techniques for microstrip impedance matching to be implemented as will be discussed further below.

The termination 100 may further comprise a plurality of holes 118 for fastening the housing 102 to a mounting surface, such as a thermal panel, which acts as a heat sink. Alternatively the termination may be attached to the mounting surface using an adhesive. The termination 100 also has a lid 120 that provides an enclosure. The lid 120 must be at a sufficient height above the conductor 114 so that most of the electromagnetic energy is concentrated between the conductor 114 and the bottom 102*c* of the housing 102. In order to provide a tight seal between the lid 120 and the housing 102, a conductive epoxy, solder, or gasket or may be used.

The absorber 112 comprises an absorption material that absorbs the electromagnetic energy and generates heat. The absorber 112 has a first surface 112*a* that is in contact with the conductor 114 and a second surface 112*b* that is in contact with the bottom 102*c* of the housing 102. The first and second surfaces 112*a* and 112*b* have a large surface area relative to the other surfaces of the absorber 112 to transfer the majority of the generated heat in a downwards direction towards the bottom 102*c* of the housing 102. In addition, the absorber 112 is placed in intimate contact with the housing 102 thereby facilitating improved heat transfer by providing a short thermal path for the heat generated within the absorber 112 to travel to the surface upon which the termination 100 is mounted and which acts as a heat sink. In addition, the absorber 112 is preferably disposed along only one side of the surface of the conductor 114 so that there is a short thermal path to the mounting surface. This is advantageous in situations where there is only one heat dissipation surface.

The absorber 112 may be soldered to the bottom 102*c* of the housing 102. In this case, the coefficient of thermal expansion of the absorber 112 must match the coefficient of thermal expansion of the housing 102 in order to prevent cracking of the absorber 112 (which is not desirable from a quality control point of view although the termination 100 may still remain operational). Alternatively, a compliant adhesive (not shown) may be used to attach the absorber 112 to the bottom 102*c* of the housing 102. The compliant adhesive preferably has a high thermal conductivity. The compliant adhesive may be any of various RTV (Room Temperature Vulcanization) materials such as CV-2963™ or CV-2946™ which are both made by NUSIL. RTV materials have a high operating temperature and good elasticity to accommodate a thermal mismatch. The conductor 114 is preferably attached to the absorber 112 to prevent air gaps from forming therebetween which may adversely affect the performance of the termination 100.

The absorber 112 may be made of any suitable absorption material that provides adequate absorption and thermal conductivity for the application in which the termination 100 is to be used. Some possible absorption materials include RS4200-CHP™ (i.e. silicon carbide) and loaded epoxy materials such as MF-124™. Loaded epoxy absorbers consist of powdered absorbers such as carbonyl iron powder or iron silicide encapsulated within an organic binder such as a rubber or an epoxy. However, the choice of absorption material will affect the dimensions of the termination 100 since an absorption material which provides a small amount of absorption will necessitate a larger termination 100 to provide a desired amount of absorption. This may be troublesome for certain applications in which there is limited area within which to mount the termination such as in spacecraft applications. Furthermore, for high power applications, where temperatures are generally quite high, the absorption properties and thermal characteristics of the absorption material become more important since there is more power that must be absorbed by the absorption material and the higher absorbed power will lead to a greater thermal flux density within the absorption material. The increased thermal density, without the selection of a suitable absorption material, may cause the termination 100 to fail. However, the inventor has found that ferrite materials with a high loss tangent (i.e. good electromagnetic absorption) and a high value of thermal conductivity are preferable as an absorption material for high-power applications.

It is known that ferrites are employed in tiles that are used for the suppression of electromagnetic reflections in anechoic chambers and in panels that are placed on the outside of buildings. Ferrites are also mixed into paint to reduce radar reflections from aircraft, and mixed into rubber to form seals for microwave ovens. However, in these applications, the absorption material is not required to absorb the entire incident electromagnetic energy. Therefore, characteristics such as thermal stability are less critical since the power density of the incident electromagnetic energy is much lower than that in a typical termination. In comparison with a higher power termination, a smaller amount of heat is generated within the absorption material in the aforementioned applications.

For example, a termination may be subjected to 65 W of electromagnetic power that is dissipated in an area having dimensions of 0.65 inches by 0.8 inches which results in a power density of 125 W/in$^2$. In contrast, absorption panels used for buildings receive electromagnetic power broadcasted by a radio station in which the broadcasted electromagnetic power may be many megawatts at the source.

However, the electromagnetic power absorbed by an absorption panel may only be a few watts and spread over a surface area that is much larger than that of an absorber in a termination. Accordingly, the panels on a building are unlikely to exceed 70° C. Another example is the usage of ferrite in microwave oven door gaskets to absorb microwave energy. Microwave ovens typically have dimensions of 16 inches by 12 inches by 12 inches and power levels ranging from 150 W to 1000 W which results in a power density that is approximately 25 to 100 times smaller than that experienced in the termination example given above.

In addition, the use of ferrites as an absorption material for terminations used with a transmission line structure has heretofore not been suggested. This observation is supported by the fact that the manufacturers of absorption materials for use in terminations do not list ferrite as an absorption material. There may be a variety of reasons for this omission. For instance, the temperature stability of ferrites is known to be poor. For example, some ferrites that are used in tiles for anechoic chambers are temperature sensitive with magnetic properties that change by 50% at temperatures of 100° C. In addition, the electromagnetic properties of ferrites can vary to a large extent in the 1 GHz to 100 GHz range. Ferrites are brittle materials which results in higher machining/processing costs during the machining of ferrite components.

The inventor of the present invention has found that sintered ferrites having a high thermal conductivity provide an adequate level of absorption and thermal conduction for producing a fairly compact design for terminations used in high power applications. The ferrite must be in a solid, sintered form since solid ferrites are capable of higher thermal conductivity than ferrite powders encapsulated in an epoxy. The thermal conductivity of many ferrites is in the range of 3.2 to 4 W/m•K. However, with proper preparation, the thermal conductivity of a sintered ferrite can be increased by 40 to 50 percent which results in a thermal conductivity of approximately 4.8 to 6 W/m•K. A higher thermal conductivity is beneficial since it allows for heat to be more quickly dissipated from within the absorber 112.

Sintered ferrites with a high thermal conductivity also tend to be less porous. The sintering process is a carefully controlled manufacturing process, the details of which are proprietary to the commercial suppliers of these materials. However, the sintered ferrite preferably has a low porosity since this characteristic is associated with good thermal conductivity. An additional desirable property of a sintered ferrite is that it can typically withstand more than a thousand degrees Celsius of heat and still maintain physical integrity. This high temperature limit is in contrast to absorption materials that comprise ferrite particles in a resin which will break down at around 300° C. These materials are usually rated no higher than 260° C.

The temperature stability of the ferrite is somewhat related to its Curie temperature which is the temperature at which ferrite becomes non-magnetic and ceases to absorb electromagnetic energy. Accordingly, the sintered ferrite preferably has a Curie temperature that is higher than the maximum temperature that the absorber 112 will experience which is often in the neighborhood of 200° C. for high power applications. Hence, the Curie temperature for the ferrite absorption material is preferably above 300° C. for high power applications. The ferrite absorption material also preferably has a resistivity which is higher than $10^3$ Ω/cm. This high resistivity allows the electromagnetic energy to penetrate deeper within the absorber 112 and hence be absorbed by a greater portion of the ferrite absorber.

Ironically, sintered ferrites that provide good absorption (i.e. are lossy) for high power applications are generally manufactured to achieve low-loss (i.e. low absorption) in magnetically biased devices such as circulators. However, this magnetically biased environment does not usually occur in terminations. For example, in spacecraft applications there are restrictions on the magnetic fields produced by the spacecraft equipment to prevent interference between different pieces of equipment. Accordingly, the magnetic conditions in terminations for spacecraft applications are low.

The absorber 112 must retain its electromagnetic characteristics over a wide temperature range. To test an absorption material for temperature stability, performance versus temperature may be measured for a representative test fixture (i.e. a structure which is somewhat similar to the termination 100,) utilizing the absorption material over the temperature range expected in high power applications. The performance measurement involves measuring the variation of the absorption and impedance of the test fixture versus temperature. It is desirable for the amount of absorption to remain stable over temperature. Furthermore, impedance variation is important since the value of the impedance of the termination 100 is chosen to provide a good match to the impedance of the coaxial transmission line 106 in order to minimize the reflection of electromagnetic energy from the termination 100. Hence, it is desirable for the impedance of the termination 100 to vary as little as possible with temperature so that the termination 100 can continue to be fairly well matched to the coaxial transmission line 106 throughout the operating temperature range.

Table 1 shows the experimental results for several tested absorption materials. Testing involved providing various absorption materials for an absorber in a test device which is similar to the termination 100 but has an additional connector at the rear of the device to facilitate the measurement of absorbed power. The absorber was chosen to have a thickness of 0.08 inches, a length of 0.85 inches and a width of 1.0 inch (these dimensions are an example only and are not meant to limit the invention). The test results were obtained during a temperature increase from 25° C. to 200° C. which was effected by applying heat to the bottom of the housing of the test device. Performance was characterized in terms of absorption stability, match stability and temperature stability. Absorption stability is defined as the variation of the absorption of electromagnetic energy during an increase in temperature. Match stability is defined as the variation of the impedance of the test device during an increase in temperature. Temperature stability is a judgment of the relative merit of the absorption material based on the absorption and match stability.

TABLE 1

Experimental results

| Material | Absorption (dB) | Thermal conductivity (W/m · K) | Absorption Stability | Match Stability | Temp. Stability |
|---|---|---|---|---|---|
| RS4200-CHP ™ | 8.0 | 43.6 | −27% | 37% | poor |
| MF-124 ™ | 23.3 | 1.3 | * | * | acceptable |
| Ni—Zn Ferrite | 11.3 | 5.6 | +13.7% | 13.4% | good |

* property was not measured but assumed to be acceptable

The experimental results show that the preferred absorption material is a sintered Ni—Zn ferrite having an approximate molar composition of 0.2 moles of zinc oxide and 0.8 moles of nickel oxide for every mole of iron oxide. This composition may be represented by the formula $(ZnO)_{0.2}(NiO)_{0.8}Fe_2O_3$. The ferrite material TT2-4000™ manufactured by Trans-Tech (a subsidiary of Alpha Industries) is an example ferrite material having approximately this composition. The precise formulation and the sintering process used to produce this ferrite material is proprietary to the supplier. However, this ferrite material has a density of approximately 5.2 g/cm$^3$. As can be seen, this ferrite material has superior thermal properties compared to MF-124™ and better absorption characteristics and temperature stability than RS4200-CHP™. The Ni—Zn ferrite has an absorption that increases with an increase in temperature (i.e. positive 13.7%) which is in contrast to RS4200-CHP™ which had an absorption that decreases with an increase in temperature (i.e. negative 27%). As a general guide, any Ni—Zn ferrite with a high Curie temperature (i.e. approximately 300° C. or higher) and a high thermal conductivity (i.e. approximately 3.2 W/•K or higher) and a loss tangent greater than 0.1 is preferable.

The inventor limited his investigation to nickel-based ferrites but anticipates that lithium-based ferrites with high Curie temperatures may also be appropriate absorption materials for high power applications. This conclusion is based on the observation that lithium-based ferrites that are used in transformer coils for cell phones become quite lossy at higher frequencies. Furthermore, lithium-based ferrites have a high dielectric constant and may be sintered to provide an appropriate thermal conductivity.

The inventor has also found that the dielectric constant of the ferrite material correlates well with the porosity of the ferrite material and hence the thermal conductivity of the ferrite material. For instance, a ferrite material with a low porosity will also have a high dielectric constant which may, for example, be on the order of 12 to 14. In contrast, prior art ferrite absorption materials used in anechoic chamber tiles and ferrite beads, for example, have dielectric constants on the order of 7 to 9.

However, an absorption material with a high dielectric constant will have a lower wave impedance than the medium (i.e. air, vacuum or some other dielectric) between the conductors of the transmission line structure. The wave impedance of a material influences the impedance of the device containing the material which may in turn lead to an impedance mismatch between the device and the transmission line structure. This results in reflections. To some extent varying the geometry of the transmission line structure can mitigate the impedance mismatch, but this approach may not always be practical or sufficient. However, two alternate methods of accommodating the mismatch in wave impedance may be used including varying the cross section or the composition of the absorber 112 and/or the configuration of the conductor 114 as is further described below.

It should be borne in mind that a wide variety of sintered ferrite materials may be suitable for high power applications since the chemical composition of a ferrite can be changed to tailor its electromagnetic properties. For instance, the general formula for the ferrite described above is $MFe_2O_4$ or equivalently $MOFe_2O_3$ where M is a divalent cation and MO is a divalent metal oxide. Substitutions can be made for the divalent cation. For instance, magnesium, manganese, nickel, cobalt and zinc are common substitutions. Monovalent lithium in equal amounts with trivalent iron is also a common substitution. Substitutions may also be made for a portion of the trivalent iron. Common substitutions include aluminum or gadolinium. In addition, some trace elements may be added to the ferrite to facilitate production of the absorption material or to alter the properties of the ferrite such as resistivity or magnetostriction as is commonly known by those skilled in the art. The text, "Handbook of Microwave Ferrite Materials", Academic Press, ©1965, edited by Wilhelm Von Aviock provides insight into the variety of material formulations that are possible.

Figure 3C:
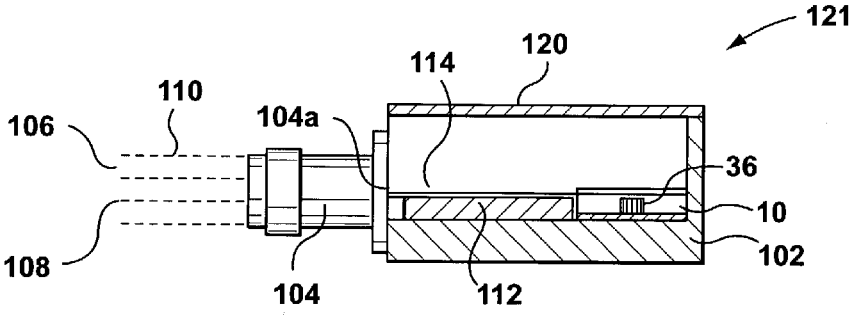
FIG. 3*c* is a partial cross-sectional side view of an alternative embodiment of a termination in accordance with the present invention.

Referring now to FIG. 3*c*, shown therein is an alternative embodiment of a termination 121 that incorporates the resistive film chip 10 of FIG. 1*a* at the rear of the termination housing 102*a*. In this configuration, the termination 121 has a similar construction to the prior art termination 30 shown in FIGS. 1*d* and 1*e*. However, the termination 121 incorporates the absorber material 112 instead of the low loss dielectric 46 to absorb a portion of the incoming electromagnetic energy. Accordingly, the resistive film chip at the rear of the termination 121 does not have to absorb as much electromagnetic energy as does the resistive film chip in termination 30. In this configuration, the energy reflected at the rear of the termination 121 is minimal.

Figure 4:
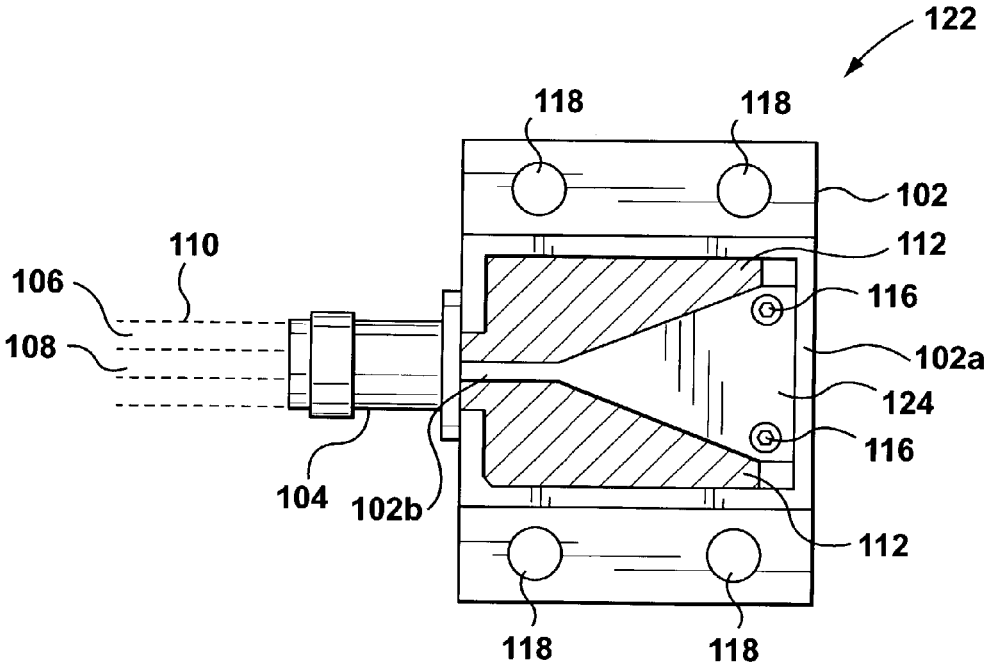
FIG. 4 is a partial cross-sectional top view of an another alternative embodiment of a termination in accordance with the present invention.

Referring now to FIG. 4, shown therein is an alternative embodiment of a termination 122 having the same components as the termination 100 except that the termination 122 has a conductor 124 that has an increasing width along a portion thereof. Increasing the width of the conductor 124 provides a greater amount of contact with the absorber 112 so that a greater amount of the absorber receives the electromagnetic energy provided by the coaxial transmission line 106 thereby resulting in a greater amount of absorption. This is in contrast to the termination 100, which has a narrower conductor 114 throughout. The enlarged conductor 124 therefore allows for the length of the termination 122 to be shortened.

Figure 5A:
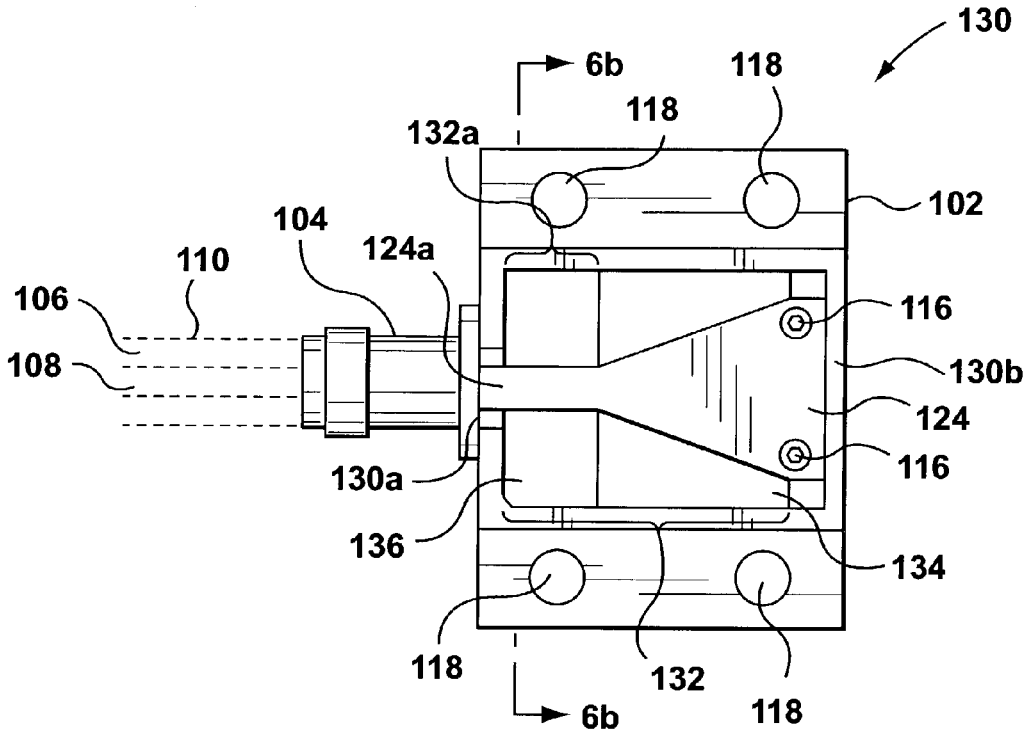
FIG. 5*a* is a partial cross-sectional top view of another alternative embodiment of a termination in accordance with the present invention.
Figure 5B:
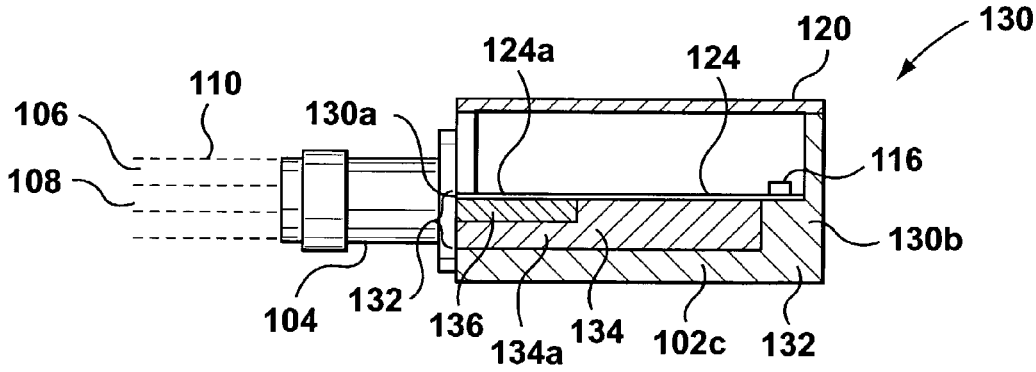
FIG. 5*b* is a partial cross-sectional side view of the termination of FIG. 5*a;*

Referring now to FIGS. 5*a* and 5*b*, shown therein is another alternative embodiment of a termination 130 having similar components as termination 122 except that the absorber 112 has been replaced by a composite absorber 132 comprising an absorber 134, which is made from an appropriate absorption material, and a low-loss dielectric 136 which is placed above the frontal portion 134*a* of the absorber 134. The dielectric 136 may be bonded to the frontal portion 134*a* of the absorber 134 using a compliant adhesive such as RTV which has a high operating temperature and has good elasticity. The absorption material may be a sintered ferrite having a high loss tangent and a high thermal conductivity as discussed above for high-power applications. The low-loss dielectric 136 has a suitable thermal conductivity and preferably a dielectric constant that is lower than the dielectric constant of the absorber 134. The dielectric 136 may be boron nitride, teflon™, diamond, beryllium-oxide, glass or a glass-ceramic. A ceramic dielectric is preferable if the termination 130 is to be used in high-power applications since a ceramic can withstand high temperatures. Furthermore, a crystalline dielectric may be preferred over an amorphous dielectric since crystalline dielectrics are often better heat conductors.

The effective dielectric constant of the front section 132*a* of the composite absorber 132*a* is lower than that of the absorber 112 since the dielectric constant of the front section 132*a* of the composite absorber 132 is between the dielectric constants of its constituent components. The reduced effective dielectric constant for the front section of the composite absorber 132 makes it easier to match the impedance of the coaxial transmission line 106 to impedance of the termination 130 than to termination 122 having similar materials and geometry. This is especially important near the front 130*a* of the termination 130 where a mismatch in impedance directly results in degraded performance. Impedance mismatches are more allowable near the rear 130*b* of the termination 130 where the electromagnetic energy has already been attenuated due to absorption and where the reflected energy undergoes addition attenuation traveling in the reverse direction.

The addition of the dielectric 136 within the composite absorber 132 also allows for controlling the rate at which electromagnetic energy is absorbed by adjusting the percentage of the dielectric 136 within the composite dielectric 132. For instance, increasing the amount of the dielectric 136 and decreasing the amount of the absorber 134 results in a composite absorber which will absorb a smaller amount of electromagnetic energy. Also, by increasing the amount of dielectric 136, while keeping the amount of absorber 134 constant, the spacing from the conductor 124 to the bottom 102*c* of the housing 102 increases and the effective dielectric constant of the composite absorber 132 decreases which allows wider widths to be used for the frontal portion of the conductor 124*a*. This is beneficial since a wider conductor is more practicable and less susceptible to tolerance variation.

The addition of the dielectric 136 in conjunction with the thinner frontal portion 134*a* of the absorber 134 reduces the amount of absorption that occurs at the front of the termination 130. Accordingly, the composite absorber 132 will absorb proportionally more electromagnetic energy towards the rear of the composite absorber 132. This is important since the incoming electromagnetic energy is at full strength at the front 130*a* of the termination 130. Accordingly, by absorbing a smaller portion of the electromagnetic energy at the front 134*a* of the absorber 134, there will be a reduced temperature rise at the front 134*a* of the absorber 134 and there will be a better distribution of heat generation throughout the absorber 134.

Accordingly, varying the thickness of the absorber 134, in a direction parallel to the direction of propagation of the electromagnetic energy, alters the absorption profile of the composite absorber 132. The absorption profile is defined as the amount or percentage of electromagnetic energy that is absorbed along the length of the composite absorber 132. This concept is illustrated in the following example in which a termination has an absorber that is 1.8 inches long and must provide 18 dB of attenuation in the forward propagation direction. The percentage absorption of the electromagnetic energy is shown in Table 2. Each "section" referred to in Table 2 covers 0.3 inches of the termination. Section 1 occurs at the front of the termination and section 6 occurs at the back-end of the termination.

The first termination design (i.e. Design #1) has a uniform absorber such as that shown in FIGS. 3*a* to 3*c* and FIG. 4. Accordingly, design #1 must provide 3 dB of attenuation for every section. In the first section, there is 3 dB of attenuation so that half of the incoming electromagnetic energy is absorbed. Accordingly, the temperature in the absorber will be extremely high in the first section and not as high in the rest of the absorber. The second termination design (i.e. Design #2) has a non-uniform absorber such as that shown in FIGS. 5*a* and 5*b*. In this case, the termination is designed to absorb the electromagnetic energy without overheating any section of the absorber, as is evident from the approximately uniform amount of absorption over the first four sections. The increase in absorption from 15% to 28% (i.e. from section 3 to section 4) of Design #2 corresponds to the region of the termination 130 where the dielectric 136 ends and the composite absorber 132 is comprised of only the absorber 134.

TABLE 2

Proportion of Absorbed Electromagnetic Energy for different Termination Designs

| Section | Percentage Absorption for Design #1 | Percentage Absorption for Design #2 |
|---|---|---|
| 1 | 50 | 25 |
| 2 | 25 | 20 |
| 3 | 12.5 | 15 |
| 4 | 7.25 | 28 |
| 5 | 3.125 | 9 |
| 6 | 1.56 | 3 |

The termination 130 allows the rate of absorption of electromagnetic energy to be controlled in a number of ways. Firstly, the length and/or the width of the conductor 124 can be decreased(increased) to transfer less(more) of the electromagnetic energy to the composite absorber 132 for a smaller(greater) amount of absorption. Secondly, an absorption material can be chosen that has a lower(higher) loss tangent to decrease(increase) the rate at which electromagnetic energy is absorbed by the absorber 134. Thirdly, in the composite absorber 132, an absorption material having a high loss tangent may be blended with a material having a low loss tangent material to control how much electromagnetic energy is absorbed.

Figure 6A:
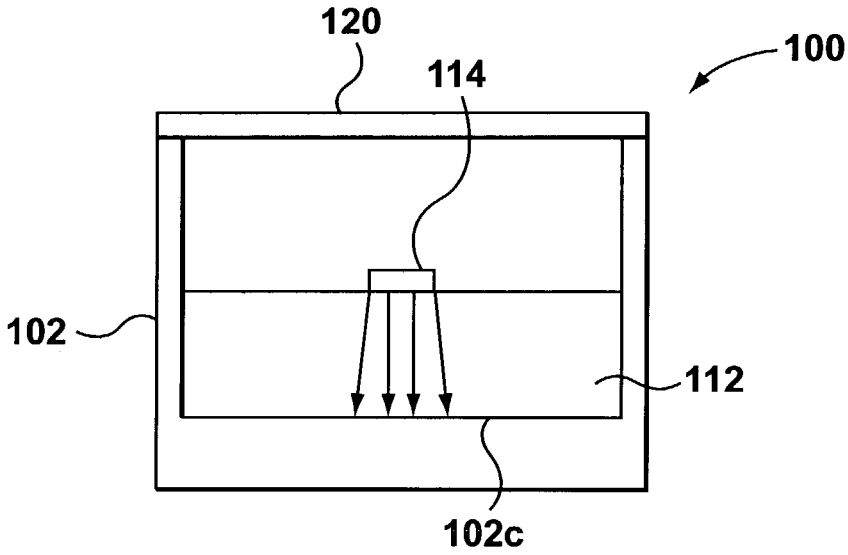
FIG. 6*a* is a cross-sectional end view showing the E-field distribution for the termination of FIG. 3*a;*
Figure 6B:
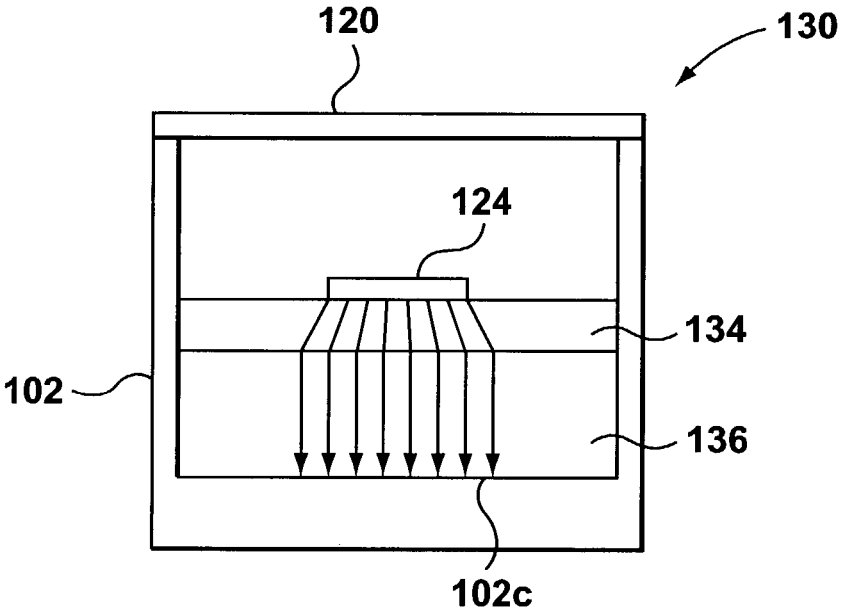
FIG. 6*b* is a cross-sectional end view showing the E-field distribution for the termination of FIG. 4*a;*

Referring now to FIGS. 6*a* and 6*b*, shown therein is a cross-sectional view of the terminations 100 and 130 taken along sectional lines 6*a*–6*a* and 6*b*–6*b* respectively (see FIGS. 3*a* and 5*a*) showing the E-field (i.e. electric field) distribution when electromagnetic energy is propagated between the conductors 114 (124) and the bottom 102*c* of the housing 102. As can be seen, the E-field is not spread over as large a portion transverse to the longitudinal axis of the absorber 112 in the termination 100 as in the case of the termination 130. This is due to two reasons: the low-loss dielectric 136 in termination 130 allows for a greater fringing of the E-field; and the stripline 124 for the composite section is wider to meet impedance matching constraints. Accordingly, the incorporation of the dielectric 136 into the composite absorber 132 produces a configuration which spreads the E-field over a larger portion of the absorber 134 in a direction transverse to the direction of propagation of the electromagnetic energy so that more of the absorber 134 participates in the absorption of electromagnetic energy. As a result, the heat generated within the absorber 134 is distributed more uniformly rather than being concentrated in a limited area as is the case for the absorber 112.

Figure 7A:
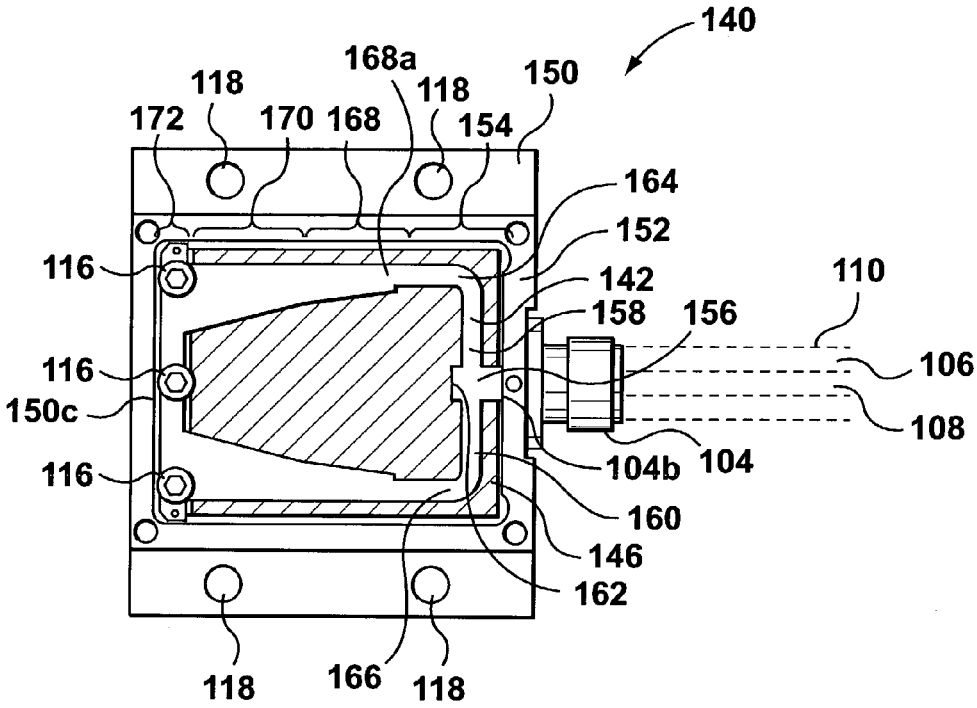
FIG. 7*a* is a partial cross-sectional top view of an alternative embodiment of a termination in accordance with the present invention.
Figure 7B:
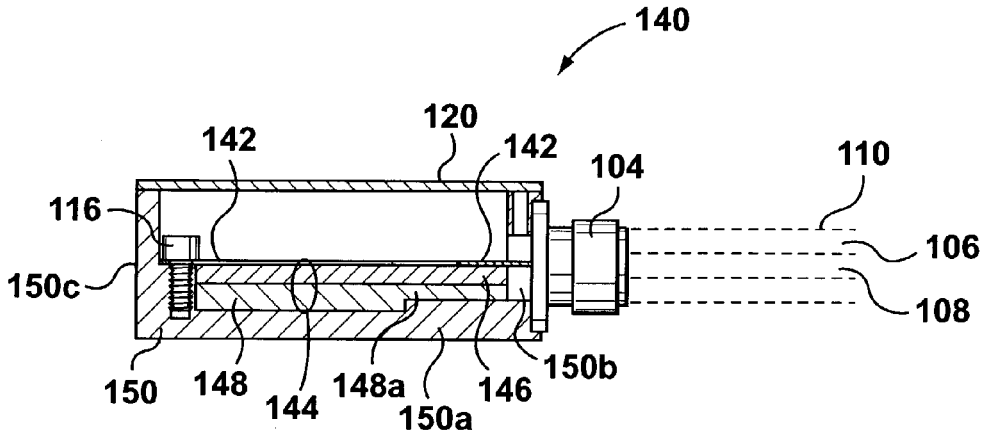
FIG. 7*b* is a partial cross-sectional side view of the termination of FIG. 7*a;*

Referring now to FIGS. 7*a* and 7*b*, shown therein is a further alternative embodiment of a termination 140 in accordance with the present invention. The termination 140 is similar to those previously described except for the incorporation of a conductor 142 in the form of a bifurcated microstrip, and a composite absorber 144 comprising a full length dielectric 146 and a stepped absorber 148 with the step occurring at the bottom 148*a* of the absorber 148. The termination 140 further has a housing 150 with a complimentary surface at the bottom 150*a* of the housing 150 to accommodate the stepped portion 148*a* of the absorber 148. The termination 140 further comprises a gasket 152 for preventing leakage of electromagnetic energy from the termination 140. This is important for electromagnetic compatibility between the termination 140 and other electronic components that may be located nearby. The gasket 152 is preferably made from copper. However, silver, aluminum, iridium or gold may also be used. Alternatively, an electrically conductive adhesive may be used instead of the gasket 152.

The termination 140 retains a number of the features of the previous terminations 100, 122 and 130. The smaller sized absorber 148 (i.e. thinner) produces a reduction in absorption. However, if the conductor 142 were placed directly on the thinner absorber 148, the conductor 142 to ground plane spacing (i.e. the bottom of the housing 150) would be reduced. To maintain the desired impedance of the termination 140, the width of the conductor 142 must also be reduced which may not be practical. Accordingly, the dielectric 146 is used to provide support to the conductor 142 and to maintain the spacing between the conductor 142 and the ground-plane. Hence, the wider conductor 142 is retained with its attendant advantages. Furthermore, the lower effective dielectric constant of the composite absorber 144 allows for an even wider conductor 142. The wider conductor 142 is also less sensitive to manufacturing tolerance, and distributes the energy to a larger portion of the composite absorber 144 as discussed previously. Moreover, the smaller thickness at the frontal portion of absorber 148 is at a location where the incoming electromagnetic energy is at full strength and results in a reduction in the amount of absorption which in turn results in a smaller amount of heat generation in this region. However, the remainder of the absorber 148 is made thicker to provide a greater amount of absorption for the remaining incoming electromagnetic energy. Thus, the variation in the thickness of the absorber 148 provides for a more even thermal profile as discussed previously.

The conductor 142 is in the shape of a bifurcated microstrip to distribute electromagnetic energy to a greater portion of the composite absorber 144. This in turn results in a more uniform distribution of generated heat within the absorber 148. In addition, since the conductor 142 guides electromagnetic energy to a greater portion of the absorber 148, this allows for a reduction of the length of the housing 150. Accordingly, the conductor 142 can be shaped to accommodate packaging constraints. The geometry of the conductor 142 can also be adjusted to allow the termination 142 to be used for different frequency ranges (within certain limits) without having to make design changes to the other components of the termination 140. The conductor 142 also provides inherent stress relief since the conductor 142 is no longer a straight line but is bent to either side of the termination 140. This allows the conductor 142 to more readily elastically deform which prevents destructive stresses from occurring on a solder joint. Alternatively, an Omega-shaped bend, which is a vertical bend or crimp, may be used in the conductor 142 to provide stress relief. The slip-joint described earlier may also be used.

The ability to easily fabricate the conductor 142 in a variety of shapes provides greater flexibility in matching the impedance of the termination 140 to that of the coaxial transmission line 106. For instance, the geometry of the conductor 142 may be adjusted as at location 168*a* to compensate for the discontinuity in impedance that is introduced by the increase in the thickness of the absorber 148 as seen at location 148*a*. In addition, a number of design techniques for microstrip impedance matching may be used, as is commonly known by those skilled in the art, which include increasing(decreasing) the width of the conductor 142 to decrease(increase) the impedance of the stripline structure, and incorporating stubs and notches into the conductor 142.

The conductor 142 illustrates the variety of adjustments that can be made. It consists of a number of stages having various impedances. The conductor 142 has a first stage 154 comprising a power divider 156 that divides the incoming electromagnetic energy into two parts for transmission down either a first branch 158 or a second branch 160. The first stage 154 also has a stub 162 for introducing a capacitance into the termination 140 to match the impedance of the termination 140 to the impedance of the coaxial transmission line 106. The stub 162 is sized empirically and compensates for the overall impedance discontinuity due to the remainder of the termination 140. The first and second branches 158 and 160 both utilize rounded bends 164 and 166 rather than sharp bends for reducing stress concentrations thereat since sharp corners are more likely to crack. Furthermore, the rounded bends 164 and 166 reduces the high electromagnetic field concentration associated with sharp corners, thereby reducing the likelihood of electrical discharge or arcing.

The conductor 142 further has a second stage 168 that is increased in width (i.e. flared out) at a first rate for reducing the impedance of that portion of the termination 140. There is a step change in impedance at position 168*a* in the second stage 168 to compensate for the step increase in the thickness of the absorber 148 at position 148*a*. The step increase in the width of the conductor 142 at position 168*a* results in a decrease in impedance whereas the step increase in the thickness of the absorber 148 at position 148*a* results in an increase in impedance. The conductor 142 further has a third stage 170 which is increased in width at a second rate for reducing the impedance of that portion of the termination 140. The second rate of width increasing is preferably greater than the first rate of width increasing so that the conductor 142 is in contact with a progressively larger portion of the composite absorber 144 to promote the absorption of proportionally more electromagnetic energy. The width of the branches 158 and 160 is increased only along the inner edges in stages 168 and 170 because of space limitations (i.e. close to the sides of the housing 150). The electrical length of each of the first and second stages 154 and 168 are approximately a quarter wavelength. The conductor 142 is fastened to the back 150*c* of the housing 150.

Figure 8A:
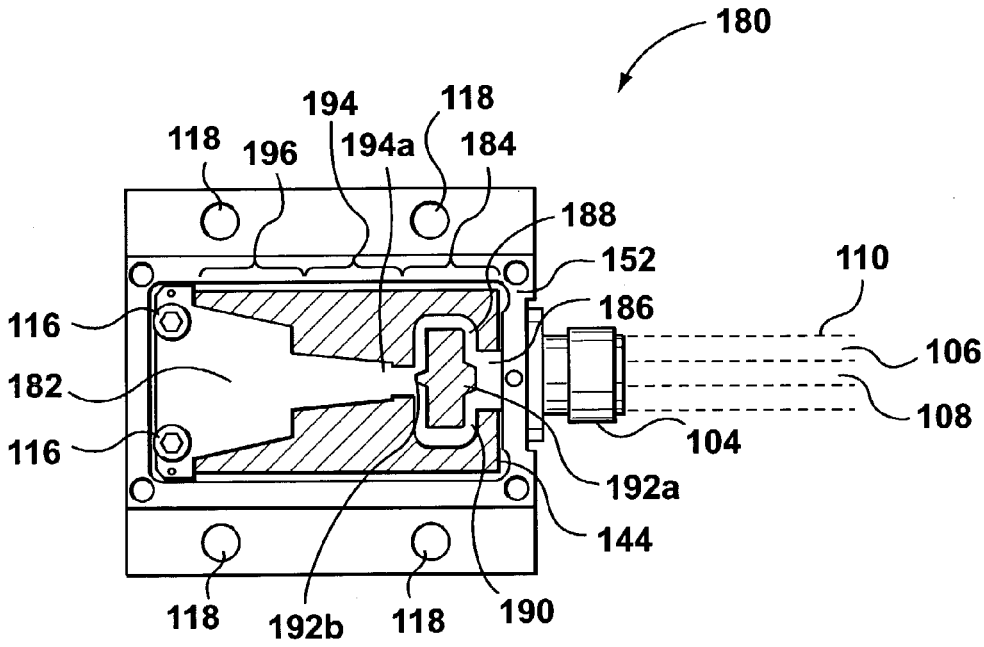
FIG. 8*a* is a partial cross-sectional top view of an alternative embodiment of a termination in accordance with the present invention.
Figure 8B:
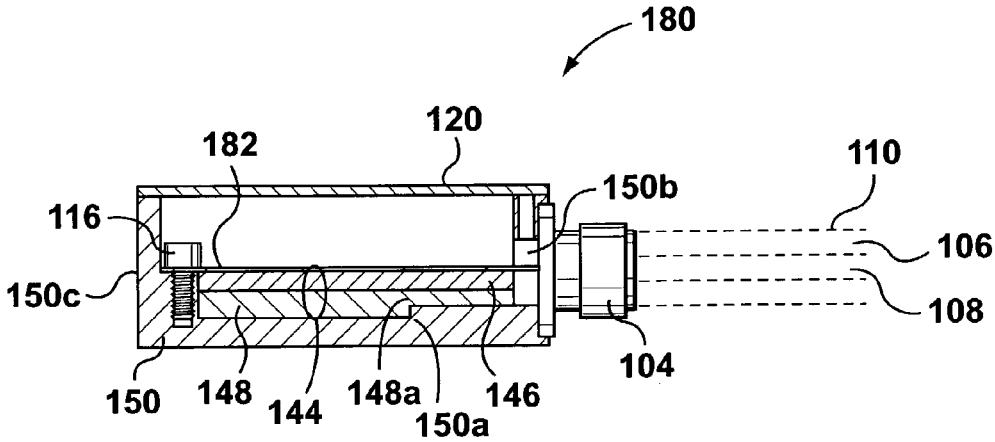
FIG. 8*b* is a partial cross-sectional side view of the termination of FIG. 8*a;*

Referring now to FIGS. 8*a* and 8*b*, shown therein is an alternative embodiment of a termination 180 in accordance with the present invention. The termination 180 is similar to the termination 140 with the exception of an alternative conductor 182. Accordingly, only the conductor 182 will be described. The conductor 182 has a first stage 184 with a power divider 186 that divides the incoming electromagnetic energy into two parts for transmission down either a first branch 188 or a second branch 190. The first stage 184 also has notches 192*a* and 192*b* for introducing an inductance into the termination 180 to match the impedance of the termination 180 to the impedance of the coaxial transmission line 106. The notches 192*a* and 192*b* are sized empirically and compensate for the overall impedance discontinuity due to the remainder of the termination 180. The first and second branches 188 and 190 are swept to the sides of the composite absorber 144 to distribute incoming electromagnetic energy to a larger portion of the composite absorber 144. The first and second branches 188 and 190 use rounded bends to provide stress relief and minimize the occurrence of arcing as previously described. In addition, the length of each of the two branches 188 and 190 is preferably approximately a quarter wavelength at the frequency of operation of the termination 180 so that reflections from the impedance discontinuity at the position at which the branches form and from the position at which the branches rejoin approximately cancel each other out.

The conductor 182 also has second and third stages 194 and 196 in which the width of these sections are increased to provide for an impedance transition and to provide a greater amount of absorption at the rear of the termination 180. The step change in impedance at position 194*a* coincides with the step change in the thickness of the absorber 148 at position 148*a* so that the reflections caused by these two impedance discontinuities compensate for one another. Furthermore, the second stage 194 is approximately one-quarter wavelength in length so that reflections from the two steps at either end of the second stage 194 will be approximately 180 degrees out of phase and cancel out.

It should be noted that different dimensions and materials may be selected for the terminations 140 and 180 to achieve a desired performance or operation in a given frequency range For instance, the thickness, length and width of any of the dielectric 146 and the absorber 146 may be varied either alone or in combination. Various materials having different absorption and thermal properties may be selected for any of the dielectric 146 and the absorber 148. In addition, various dimensions could be used for the conductors 142 and 148.

Figure 9A:
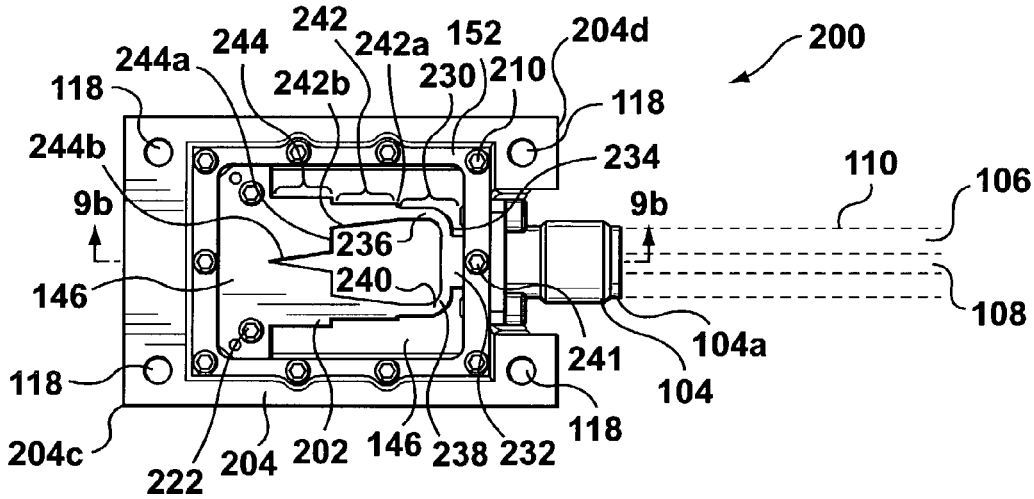
FIG. 9*a* is a top view of an alternative embodiment of a termination with the lid removed.
Figure 9B:
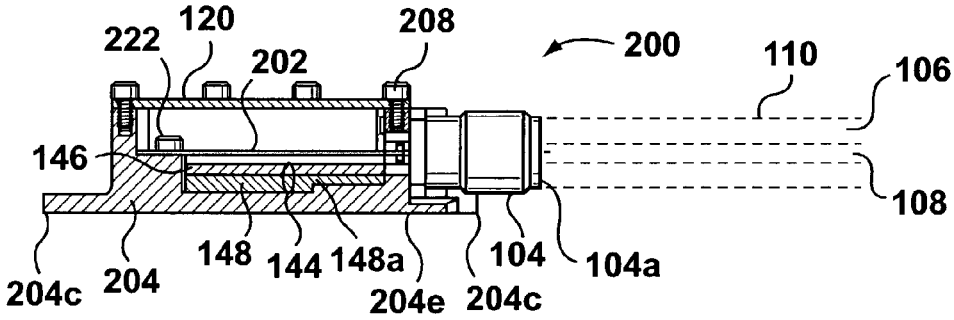
FIG. 9*b* is a partial cross-sectional side view of the termination of FIG. 9*a* with the lid in place.
Figure 9C:
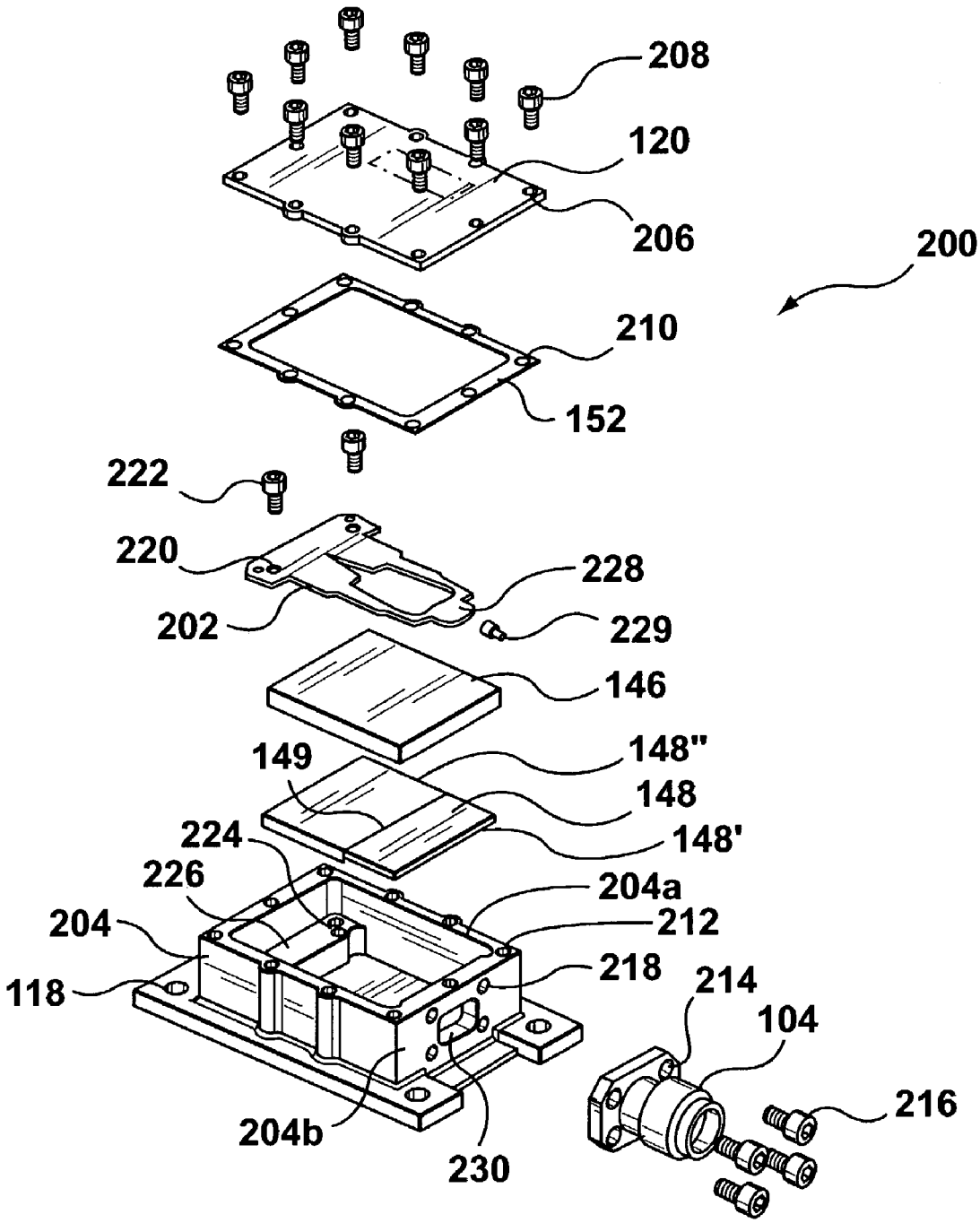
FIG. 9*c* is an exploded isometric view of the termination of FIG. 9*a;*

Referring now to FIGS. 9*a* to 9*c*, shown therein is another alternative embodiment of a termination 200 in accordance with the present invention. The termination 200 is similar to the termination 140 with the exception of an alternative conductor 202 and housing 204. The footpad (i.e. the bottom "slab" of the housing 204) is modified to be narrower and longer to accommodate packaging constraints. Furthermore, the lid 204 is secured to the housing with more fasteners to reduce leakage of electromagnetic radiation. FIG. 9*c* illustrates that the lid 120 has a plurality of holes 206 which each receive a fastener 208. The fasteners 208 engage hole 210 in the gasket 152 and holes 212 on the upper surface 204*a* of the housing 204 to secure the lid 120 and the gasket 152 to the housing 204. Furthermore, the connector 104 has several apertures 214 for receiving fasteners 216. The fasteners 216 engage apertures 218 on the front 204*b* of the housing 204 to secure the connector 104 to the housing 204 so that the housing 204 is in electrical communication with the outer conductor of the coaxial transmission line 106 to which the termination 200 is connected. The connector 104 is preferably a TNC connector, which is a common type of connector used for power applications in the range of 50 to 200 watts. The termination 200 also includes the composite absorber 144 which comprises the layer of dielectric 146 and the absorber 148 having a step at position 148*a* as described previously for the termination 140.

The conductor 202 has apertures 220 for receiving fasteners 222 that engage apertures 224 located on an inner ridge 226 within the housing 204 to secure the conductor 202 to the housing 204 of the termination 200 which is grounded. The conductor 202 further has a tip 228 to which a pin 229 is soldered. The tip 228 of the conductor 202 projects through an opening 230 in the front 204*b* of the housing 204 to provide a slip joint connection between the conductor 202 and the connector 104, as previously described, so that the conductor 202 is in electrical communication with the inner conductor of a coaxial transmission line to which the termination 200 is connected.

The conductor 202 is a bifurcated microstrip with a first stage 230 having a power divider 232 for sending incoming electromagnetic energy to a first branch 234 having a rounded bend 236 and a second branch 238 having a rounded bend 240. The conductor 202 further has a stub 241 at the rear portion of the power divider 232 to compensate for the overall impedance discontinuity due to the remaining stages of the conductor 202. The conductor 202 has a second stage 242 which provides a step discontinuity 242*a* in impedance. The second stage 242 also has a region 242*b* with a width that increases on one side thereof at a first rate to provide a more gradual change in impedance and to provide more contact with the composite absorber 144. The conductor 202 also has a third stage 244 which also has a step discontinuity 244*a* in impedance as well as a region 244*b*. The region 244*b* has a width that increases at a second rate on one side thereof to provide for a greater change in impedance as well as greater contact with the composite absorber 144 to provide for more absorption near the rear of the termination 200. Alternatively, since there is a step increase in the width of the conductor 202 between the second and third stages 242 and 244, the rate at which the width of the third stage 244 of the conductor 202 is increased can be the same as or smaller than the rate at which the width of the second stage 242 is increased. The conductor 202 further has a fourth stage 246 where the first and second branches 234 and 238 join and the conductor 202 is short circuited (i.e. connected to the housing 204 which is grounded). The conductor 202 is similar to the conductor 142 of the termination 140 except that the various stages of the conductor 202 have been made wider to provide more surface contact with the composite absorber 144.

As indicated previously, the size and shape of the termination may be varied dramatically to accommodate different needs. For illustrative purposes, a few dimensions that may be used for termination 200 are presented. The termination 200 may have a length of 2.74 inches from the front edge 104*a* of the connector 104 to the rear 204*c* of the housing 200, and a length of 2.4 inches from the front edge 204*d* of the housing 204 to the rear 204*c* of the housing 204. The termination 200 may also have a width of 1.6 inches and a height of 0.73 inches. Furthermore, the conductor 202 may be at a height of approximately 0.33 inches above the bottom 204*e* of the housing 204. These dimensions allow for the termination 200 to operate in a frequency range of 3.4 to 4.2 GHz which is a common satellite frequency band. These dimensions are provided for exemplary purposes only and are not meant to limit the invention. Other dimensions may be used with a consequent effect on the thermal behavior and the frequency range of the termination 200.

Figure 10A:
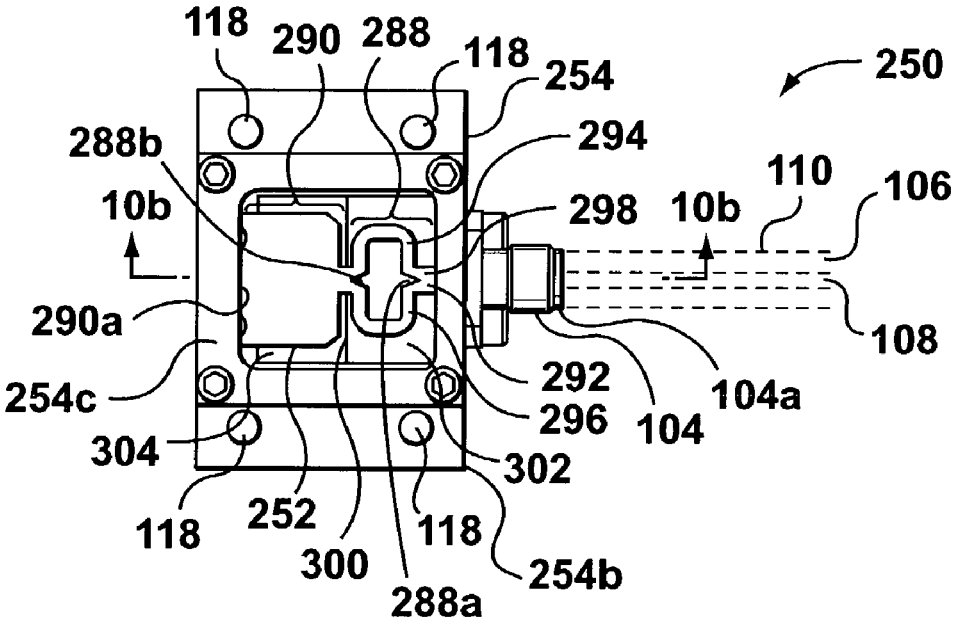
FIG. 10*a* is a top view of an alternative embodiment of a termination with the lid removed.
Figure 10B:
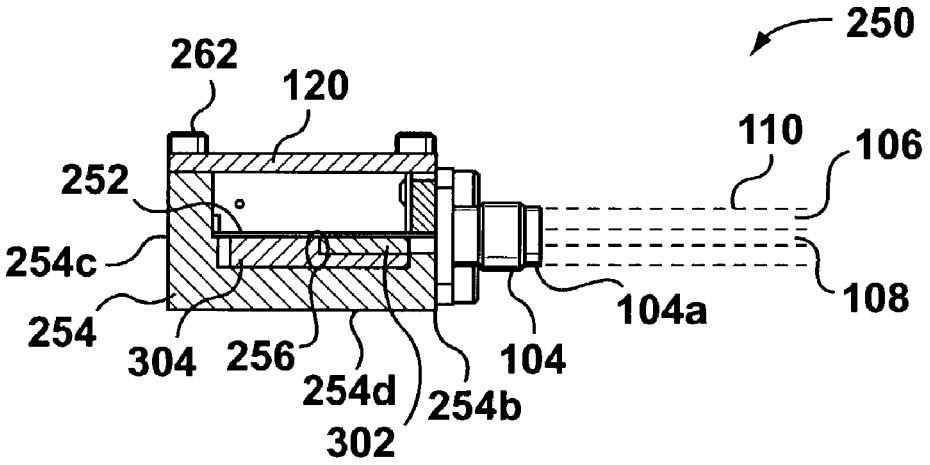
FIG. 10*b* is a partial cross-sectional side view of the termination of FIG. 10*a* with the lid in place.
Figure 10C:
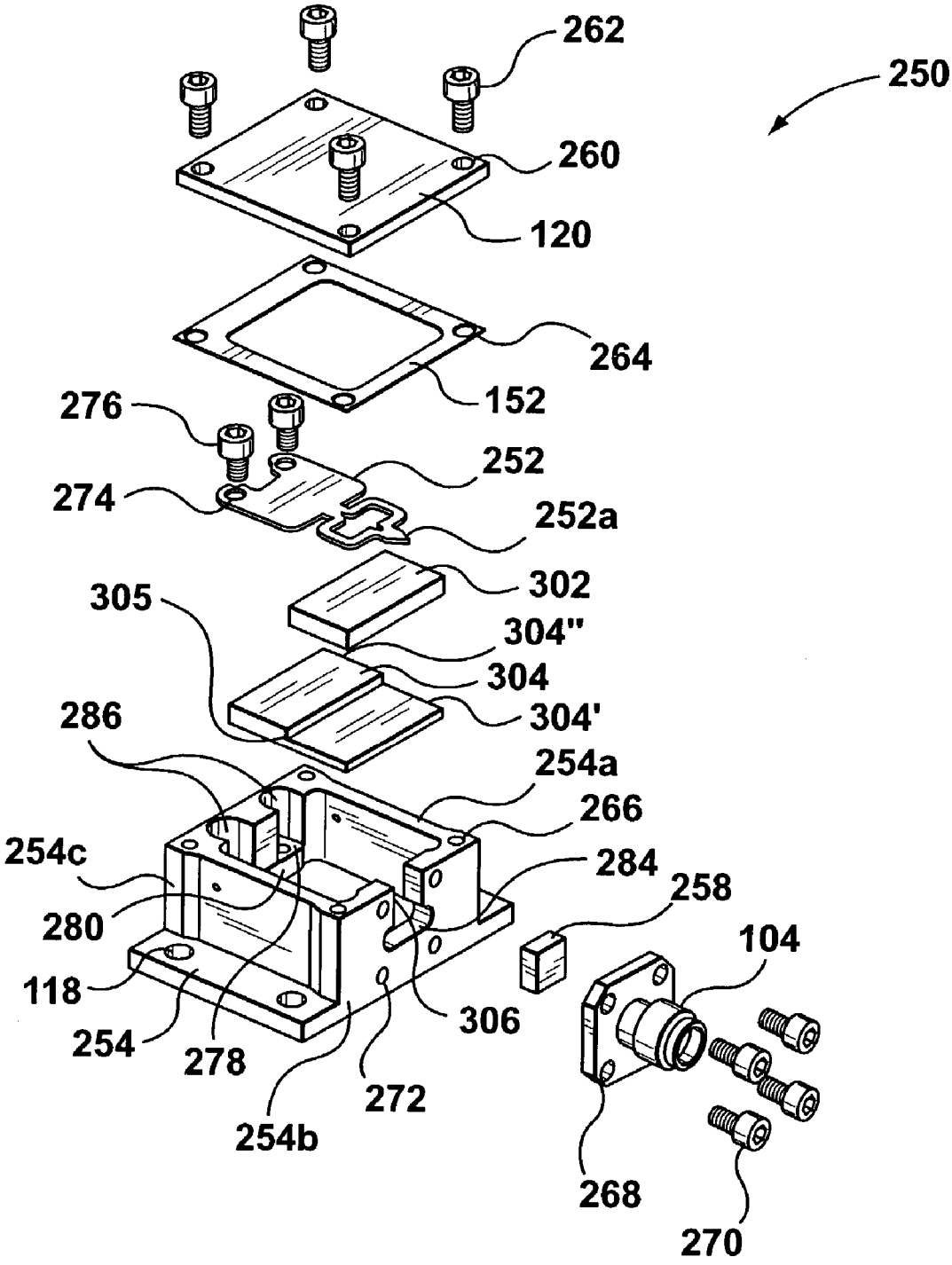
FIG. 10*c* is an exploded isometric view of the termination of FIG. 10*a;*

Referring now to FIGS. 10*a* to 10*c*, shown therein is another alternative embodiment of a termination 250 in accordance with the present invention. The termination 250 is similar to the termination 180 with the exception that the termination 250 has been designed to have a smaller size. Accordingly, the termination 250 has an alternative conductor 252, housing 254, and composite absorber 256. The termination also has an additional dielectric block 258 and an alternate choice for the connector 104. FIG. 10*c* illustrates that the lid 120 has a plurality of apertures 260 which each receive a fastener 262. The fasteners 262 engage apertures 264 in the gasket 152 and apertures 266 on the upper surface 254*a* of the housing 254 to secure the lid 120 and the gasket 152 to the housing 254. Furthermore, the connector 104 has several apertures 268 for receiving fasteners 270. The fasteners 270 engage apertures 272 on the front 254*b* of the housing 254 to secure the connector 104 to the housing 204 so that the housing 204 is in electrical communication with the outer conductor 110 of the coaxial transmission line 106 to which the termination 250 is connected. The connector 104 is preferably an SMA connector which is a common type of connector used for power applications in the range up to 65 watts.

The conductor 252 has apertures 274 for receiving fasteners 276 that engage apertures 278 inner ridge 280 within the housing 254 to secure the conductor 252 to the housing 254 which is grounded. The conductor 252 further has a tip 282 which projects through an opening 284 in the front 254*b* of the housing 254 to connect the conductor 252 to the connector 104 so that the conductor 252 is in electrical communication with the inner conductor of a coaxial transmission line to which the termination 250 is connected. The housing 254 further has two recesses 286 at the inner portion of the rear 254*c* of the housing 254 to provide a space for fasteners 276 to secure the conductor 252 to the housing 254 in order to shorten the length of the termination 250.

The conductor 252 is a bifurcated stripline, however, in order to reduce the size of the termination 250, the conductor 252 has only a first stage 288 and a second stage 290. The first stage 288 is similar to that of termination 180 and comprises a power divider 292 for sending incoming electromagnetic energy to a first branch 294 and a second branch 296 both having rounded bends for reducing stress and minimizing the incidence of arcing as previously described. The branches 294 and 296 provide electromagnetic energy to a greater portion of the composite absorber 256 for greater absorption and more uniform heat generation. The second stage 290 of the conductor 252 has a uniform width, introduces a large discontinuity in impedance at position 300 and is large in size to cover a greater portion of the composite absorber 256 to deliver more electromagnetic energy for absorption. Furthermore, at the rear 290*a* of the second stage 290, the conductor 252 is short circuited (i.e. connected to the housing 254 which is grounded). The position 298 where the branches 294 and 296 split apart from one another and the position 300 at the beginning of the second stage 290 introduce discontinuities in impedance which create reflections of electromagnetic energy. However, at position 300 half of the incoming electromagnetic energy has been absorbed so that not much electromagnetic energy is reflected. Furthermore, the "electrical length" of each of the branches 294 and 296 is equal to a quarter wavelength at the frequency of operation of the termination 250 so that the reflection from positions 298 and 300 preferably cancel each other. In addition, there are two notches 288*a* and 288*b* in the first stage 288 which are used to compensate for the overall discontinuity in impedance due to the remainder of the termination 250.

The composite absorber 256 comprises a dielectric 302 and an absorber 304. However, the dielectric 302 does not span the entire length of the composite absorber 256. Consequently, the absorber 304 makes up a greater proportion of the overall composite absorber 256 in order to provide a greater amount of absorption for the termination 250 particularly toward the rear of the termination 250. For high power applications, the material used for the dielectric 302 is preferably a low-loss dielectric with a low dielectric constant and the material used for the absorber 304 is preferably a sintered ferrite having a high loss tangent and a high thermal conductivity as previously discussed.

Since the termination 250 was designed to have smaller dimensions, there is a greater concentration of generated heat within the termination 250. Much of this heat will travel directly through the absorber 304 to the housing 254. However, since the absorber 304 is at full height (i.e. the top of the absorber is in contact with the conductor 252) and a small portion of this generated heat will travel through the conductor 252 to the rear 254*c* of the housing 254 and also to the front 254*b* of the housing 254 to the solder joint (not shown) which connects the tip 252*a* of the conductor 252 with the connector 104. This may result in damage to the solder joint and the failure of the termination 250. Accordingly, the housing 254 has a channel 306 for receiving the dielectric block 258 such that the dielectric block 258 is in contact with both the conductor 252, the housing 254, and the connector 104. The dielectric block 258 provides an efficient thermal path to the front 254*b* of the housing 254 for the generated heat arriving thereat thereby limiting temperature rise at the solder joint. However, the dielectric block 258 adds a capacitance to the front of the termination 254*b*. This may be addressed by reducing the width of the conductor 252. The dielectric block 258 is preferably made from a high thermal conductivity material such as boron-nitride, alumina or aluminum-nitride.

For illustrative purposes, the dimensions for the termination 250 may be chosen such that the termination 250 may have a length of 1.34 inches from the front edge 104*a* of the connector 104 to the rear 254*c* of the housing 254, and a length of 0.96 inches from the front edge 254*b* of the housing 254 to the rear 254*c* of the housing 254. The termination 250 may also have a width of 1.38 inches and a height of 0.66 inches. Furthermore, the conductor 252 may be at a height of approximately 0.27 inches above the bottom 254*d* of the housing 254. These dimensions allow the termination 250 to operate in the C-band. However, these dimensions are provided for exemplary purposes only and are not meant to limit the invention.

Although the terminations 200 and 250 were designed for operation in the C-band, the design of these terminations 200 and 252 can be altered for operation in slightly different frequency ranges. The design changes include altering the size of the terminations 200 and 250, the geometry of the conductors 202 and 252 or the materials, thickness and shape used for the elements of the composite absorbers 144 and 256.

Figure 11:
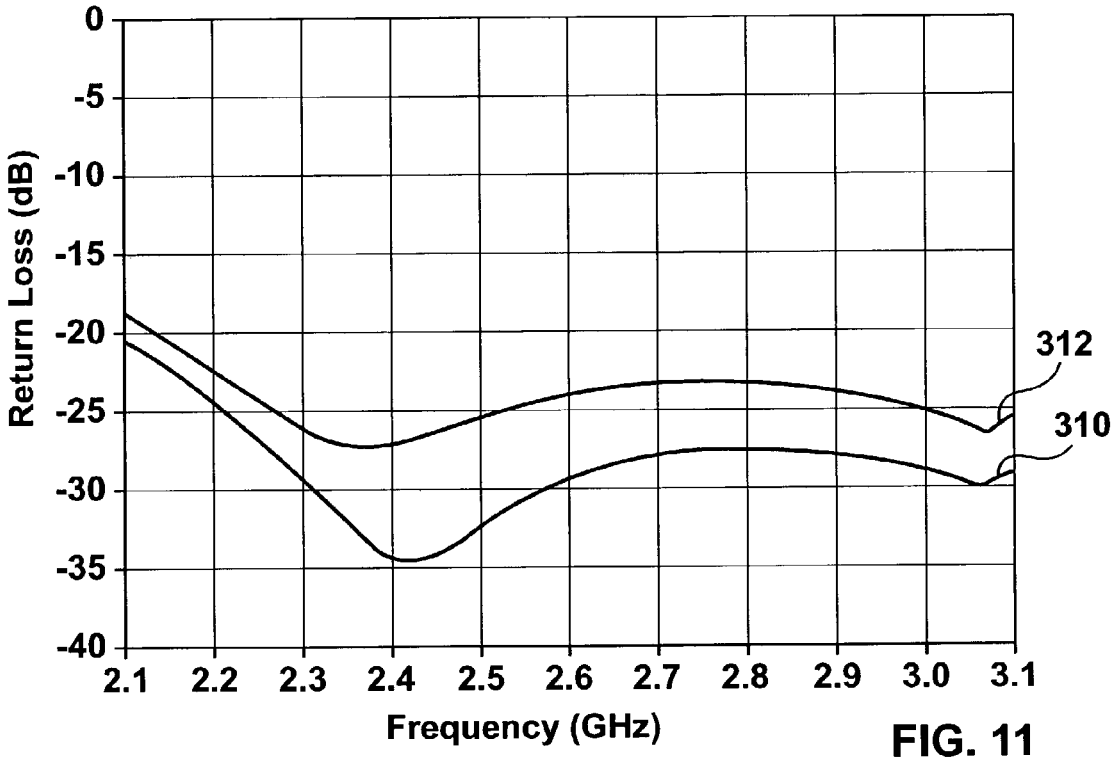
FIG. 11 is a plot of return loss versus frequency representing the match provided by the termination design of FIGS. 9*a*–9*c;*
Figure 12:
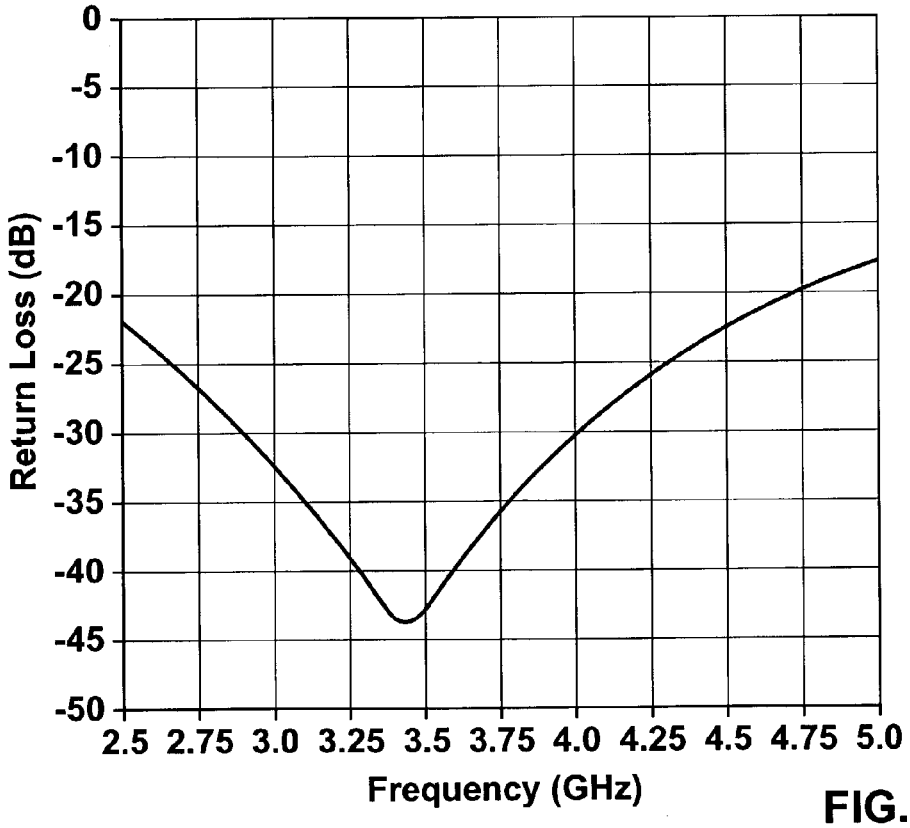
FIG. 12 is a plot of return loss versus frequency representing the match provided by the termination design of FIGS. 10*a*–10*c;*

Referring now to FIGS. 11 and 12, shown therein respectively are plots of return loss versus frequency measured at low power for terminations employing the design of terminations 200 and 250. FIG. 11 shows the performance of a termination 200' employing the design of the termination 200 but having dimensions selected for operation from 2.5 to 2.7 GHz, whereas FIG. 12 shows the performance of a termination 250' having the design of termination 250 but having dimensions for operation from 3.4 to 4.2 GHz. FIG. 11 shows measurements that were taken at two different temperatures. The first curve 310 was measured while the termination 200' was at a temperature of approximately 23° C. The second curve 312 was measured while the termination 200' was at a temperature of approximately 210° C. to simulate the effect of self heating at high power and temperature conditions. In both cases, the termination 200' provided good return loss from 2.1 GHz to 3.1 GHz. Over the particular range of interest (2.5 GHz to 2.7 GHz) the minimum return loss was approximately 28 dB at 23° C. and approximately 23 dB at 210° C. Accordingly, FIG. 11 shows that the termination 200' provides fairly stable frequency performance over a broad temperature range. FIG. 12 shows that the termination 250' provides a return loss greater than 21 dB over the broad frequency range from 2.5 GHz to 5 GHz. The curve was measured while the termination 250' was at 23° C.

The terminations of the present invention have been shown connected to a coaxial transmission line, however, usage with other transmission line structures is also possible. In particular, the terminations of the present invention may be used with stripline, shielded microstrip and waveguide transmission line structures. The terminations of the present invention may also be used with coaxial transmission lines that are oriented at right angles to the conductor in the termination.

Figure 13A:
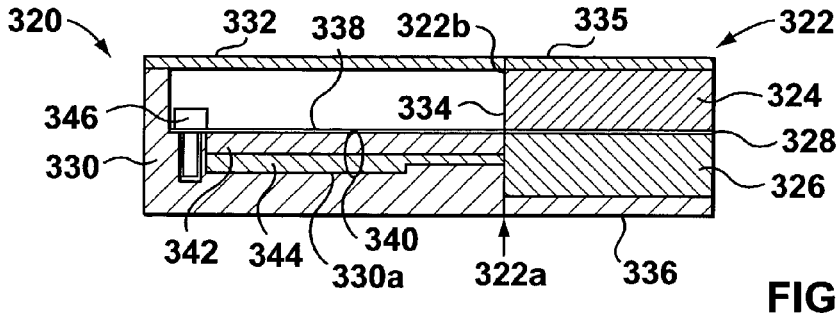
FIG. 13*a* is a partial cross-sectional side view of a termination, in accordance with the present invention, for use with a stripline transmission line.

Referring now to FIG. 13*a*, shown therein is a termination 320 that is connected to a stripline transmission line 322 having a first dielectric 324 and a second dielectric 326 disposed on either side of a conductor 328. The dielectrics 324 and 326 have a similar size and dielectric constant. Consequently, electromagnetic energy propagated within the stripline transmission line 322 is divided evenly above and below the conductor 328. The termination 320 has a housing 330 with a lid 332 and a port at junction 334 to receive electromagnetic energy from the stripline transmission line 322. The termination 320 may be connected to the stripline transmission line 322 at junction 334 via welding or soldering. Alternatively, the termination 320 may have a flange (not shown) at junction 334 which is bolted to a corresponding flange (not shown) on the end of the stripline transmission line 322. The housing 330 and the lid 332 are both electrically connected to the ground planes 335 and 336 of the stripline transmission line 322. The termination 320 further comprises a conductor 338, which is connected to the conductor 328 of the stripline transmission line 322, and a composite absorber 340 disposed between the conductor 338 and the bottom 330*a* of the housing 330. The composite absorber 340 has a dielectric 342 and an absorber 344 which are made of suitable materials as previously described. The termination 320 further comprises a fastener 346 for securing the conductor 338 to the housing 330. Similar fasteners (not shown) may be used to secure the lid 332 to the housing 330.

The impedance of the termination 320 can be adjusted to match the impedance of the stripline transmission line 322 by adjusting the width of the conductor 338, by adding notches or stubs to the conductor 338, by adjusting the spacing between the bottom 330*a* of the housing 330 and the conductor 338 selecting materials having a desired dielectric constant and thickness for the dielectric 342 and the absorber 344. The electromagnetic field structure is two-sided in the stripline transmission line 322 and one-sided in the termination 320. The adaptation of the electromagnetic field structures from two-sided to one-sided is accomplished automatically as part of the impedance matching procedure. There will be some fringing of the electromagnetic field in the region 322*b*. Alternatively, a matching transformer (not shown) may be disposed between the termination 320 and the stripline transmission line 322 as is commonly known by those skilled in the art. The matching transformer may consist of a short stripline section with a conductor having a desired geometry and/or a dielectric having certain material properties to facilitate impedance matching between the termination 320 and the stripline transmission line 322.

Figure 13B:
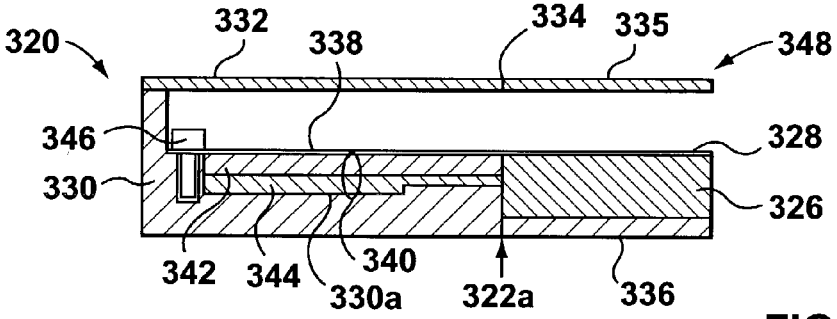
FIG. 13*b* is a partial cross-sectional side view of a termination, in accordance with the present invention, for use with a shielded microstrip transmission line.

Referring now to FIG. 13*b*, the termination 320 may also be used with a shielded microstrip transmission line 348. The shielded microstrip transmission line 348 is similar to the stripline transmission line 322 shown in FIG. 13*a* except for the removal of the dielectric 324 on top of the conductor 328. Accordingly, the field structure of the electromagnetic energy in the shielded microstrip transmission line 348 will be the same as that in the termination 320. Furthermore, the omission of the dielectric 324 provides easier access for soldering or welding the termination conductor 338 to conductor 328 of the shielded microstrip transmission line 348.

Figure 13C:
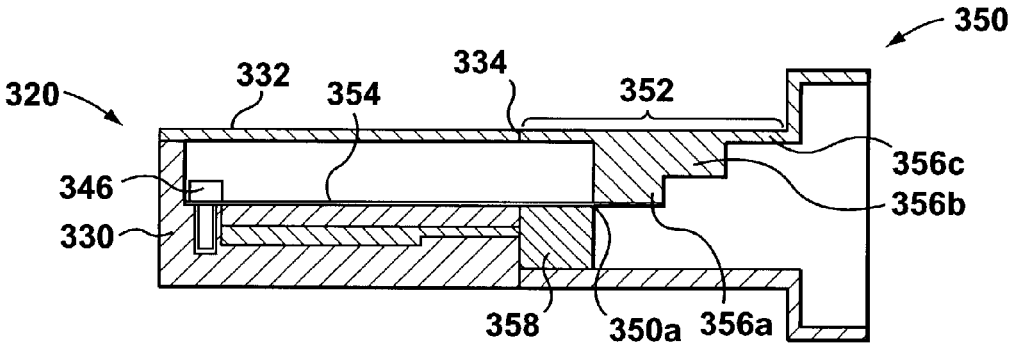
FIG. 13*c* is a partial cross-sectional side view of a termination, in accordance with the present invention, for use with a waveguide transmission line.

Referring now to FIG. 13*c*, shown therein is the termination 320 connected to a waveguide transmission line 350 via the junction 334 in a similar fashion to that described for termination 320 and the stripline transmission line 322. However, the waveguide interface poses significant design challenges since the waveguide transmission line 350 and the termination 320 differ in size, impedance and have different electromagnetic field structures. Accordingly, the electrical connection between the waveguide transmission line 350 and the termination 320 is accomplished by incorporating an impedance transformer 352 that utilizes inductive loop coupling to provide an electrical connection with the conductor 354. The impedance transformer 352 comprises a series of waveguide walls 356*a*, 356*b* and 356*c* having stepped transitions therebetween. The conductor 354 of the termination 320 proceeds down the waveguide transmission line 350 and is connected to one of the waveguide walls 356 some distance from the end 350*a* of the waveguide transmission line 350. A dielectric block 358 is placed on one side of the conductor 354 to concentrate the electromagnetic energy on that side of the conductor 354 to guide the electromagnetic energy from the waveguide transmission line 350 to the termination 320.

Alternatively, the impedance transformer 352 may comprise a single step or multiple steps which may span the full width of the waveguide transmission line 350 or which may be a narrow ridge which is disposed centrally within the waveguide transmission line 350. Alternatively, the impedance transformer 352 may have tapered steps. Changes in the cross section of the waveguide transmission line 350 might also facilitate impedance matching.

Figure 13D:
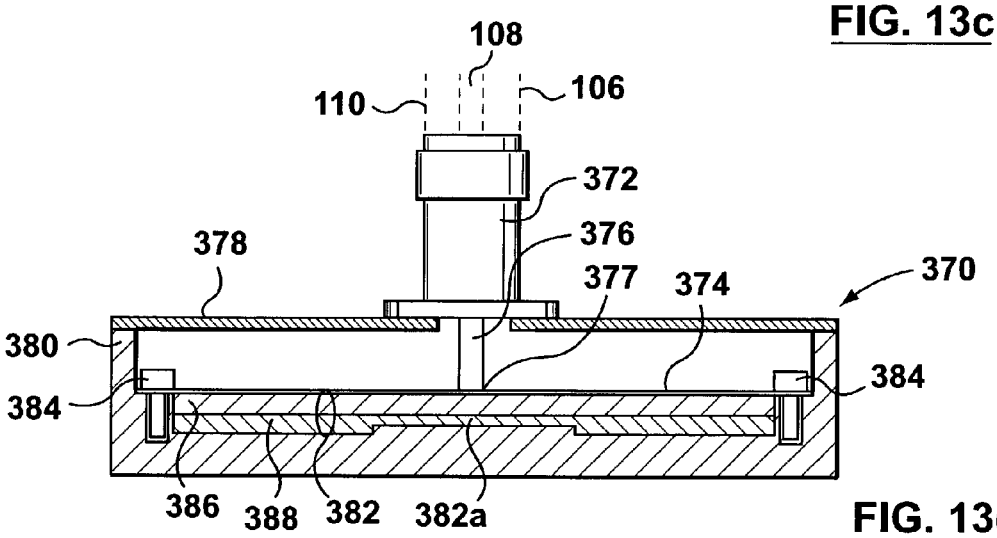
FIG. 13*d* is a partial cross-sectional side view of a termination, in accordance with the present invention, for use with a top-fed coaxial transmission line.

Referring now to FIG. 13*d*, shown therein is a top-fed termination 370 for use with a coaxial transmission line 106. The termination 370 has a connector 372 which serves as a port and is oriented at right angles to a conductor 374 within the termination 370. A stripline joint 377 is provided for attaching, preferably by soldering, the center conductor 376 of the connector 372 to the conductor 374. The termination 370 has a lid 378 and a housing 380 which are connected to the outer conductor 110 of the coaxial transmission line 106 and are therefore grounded. The conductor 374 is placed upon a composite absorber 382 and secured to the housing 380 via fasteners 384. The composite absorber 382 comprises a dielectric 386 and an absorber 388 as described for the previous terminations. However, the composite absorber 382 now has a thinner central region 382*a* where the width of the absorber 388 is thinner to reduce the amount of absorption of electromagnetic energy in the vicinity of the stripline joint 377 where the incoming electromagnetic energy is at full strength.

The electrical connection between the coaxial transmission line 106 and the top-fed termination 370 is complicated because electromagnetic energy is provided to the termination 370 at right angles to the direction of propagation of electromagnetic energy within the termination 370. Accordingly, this connection introduces a change in the field structure of the electromagnetic energy and hence introduces an impedance mismatch between the coaxial transmission line 106 and the termination 370. This impedance mismatch must be compensated by the design of the conductor 374 in accordance with the some of the features of the conductors shown for the previously discussed terminations. This includes utilizing impedance transformation regions or utilizing notches or stubs.

The connector 372 may be attached to the middle of the termination 370 as shown in FIG. 13*d* or the port 372 may be attached to one end of the termination 370. A top-fed termination 370 is attractive since not as much mounting space is required for the top-fed termination 370 compared to other terminations since the coaxial transmission line 106 is connected from the top rather than from the side as in an "end-launch configuration". This is important for applications in which there is not much mounting space such as in satellite equipment in which electrical components are closely packed. Furthermore, the connection for a top-fed termination is more easily accessible than that of a termination with an end-launch configuration.

An Application for Electromagnetic Terminations

Figure 14:
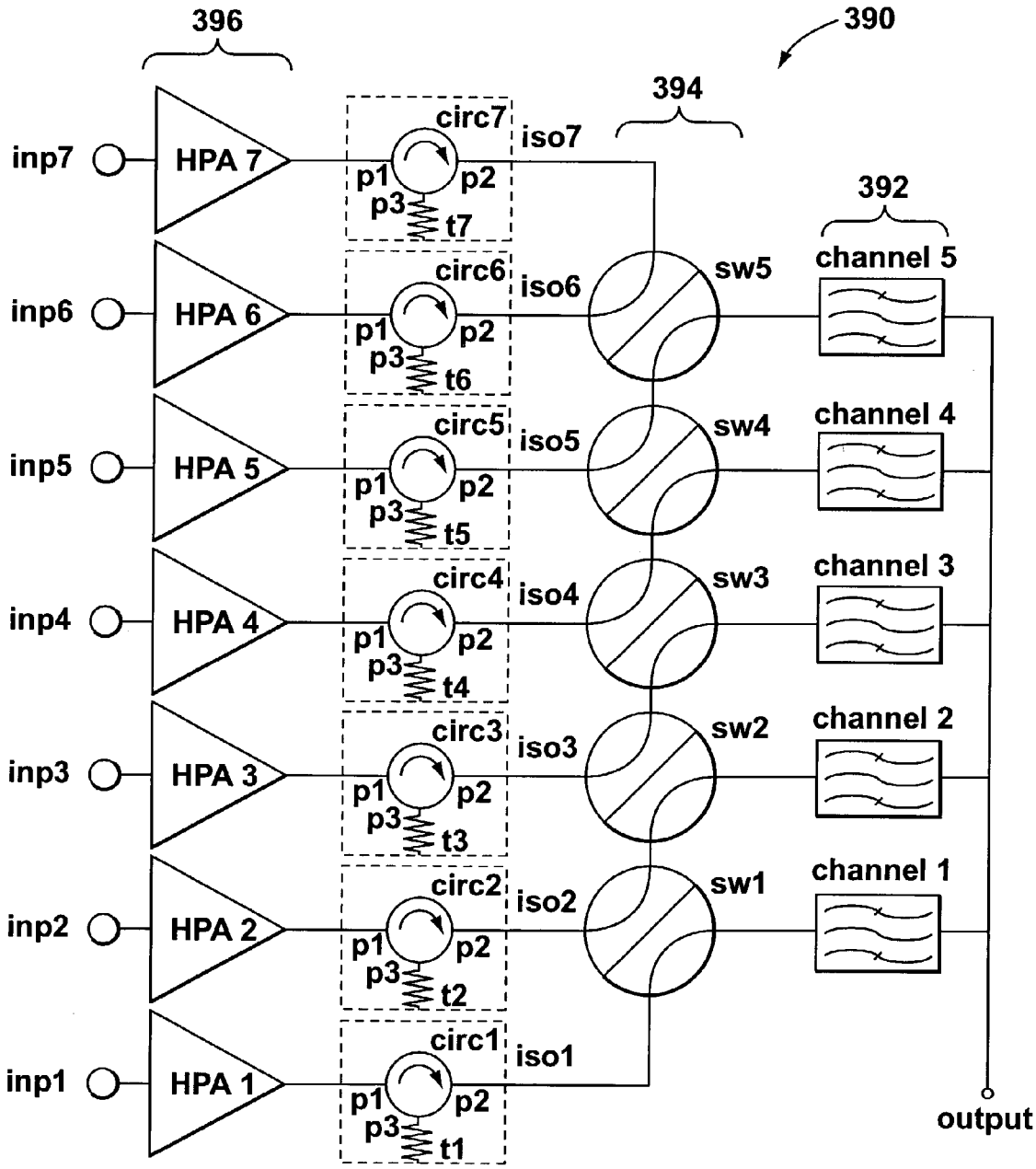
FIG. 14 is a schematic of an exemplary communication system that utilizes one of the terminations of the present invention.

Satellite communication systems frequently use high power electromagnetic terminations to protect sensitive electronic devices. Referring now to FIG. 14, shown therein is an example communication system 390 comprising a bank of channel filters 392 which is preceded by a switch network 394 comprising switches sw1, sw2, sw3, sw4 and sw5. The switch network 394 is driven by a high power amplification stage 396 comprising high power amplifiers HPA1, HPA2, HPA3, HPA4, HPA5, HPA6 and HPA7. The communication system 390 is used in satellite communications since a satellite typically receives a very weak signal from earth and must amplify the signal and rebroadcast the signal back to earth. However, for technical reasons, it is not feasible to amplify the signal using a single high power amplifier. Consequently, the signal is split into several frequency bands (i.e. channels). The signal for each channel is amplified by a separate high power amplifier and then recombined for rebroadcast.

As shown in FIG. 14, inputs inp1, inp2, inp3, inp4 and inp5 are each connected to a corresponding channel filter. The communication system 390 further has two redundant high power amplifiers HPA6 and HPA7 that may be used by appropriately setting the switches in the switching network 394. Accordingly, sixth and seventh inputs inp6 or inp7 can be connected to channel five by turning the switch sw5 an eighth or quarter turn respectively. The output node is a manifold where the outputs of each channel filter are combined and transmitted to a downstream device such as an antenna.

The communication system 390 also comprises a plurality of isolators iso1, iso2, iso3, iso4, iso5, iso6 and iso7 which each connect one of the inputs inp1, inp2, inp3, inp4, inp5, inp6 and inp7 with one of the switches sw1, sw2, sw3, sw4 and sw5. Each isolator iso1, iso2, iso3, iso4, iso5, iso6 and iso7 has a circulator circ1, circ2, circ3, circ4, circ5, circ6 and circ7 and a termination t1, t2, t3, t4, t5, t6 and t7 for which the inventive terminations described herein may be used. For each isolator iso1, iso2, iso3, iso4, iso5, iso6 and iso7, the electromagnetic energy that is received at port p1 is transferred to port p2 while the electromagnetic energy that is received at port p2 is transferred to port p3 where the electromagnetic energy is absorbed by the appropriate termination t1, t2, t3, t4, t5, t6 and t7. Accordingly, each isolator iso1, iso2, iso3, iso4, iso5, iso6 and iso7 is used to absorb reflected electromagnetic energy (which can be substantial) to protect the high power amplifiers HPA1, HPA2, HPA3, HPA4, HPA5, HPA6 and HPA7 which are sensitive electronic devices. The reflected electromagnetic energy may be due to a variety of reasons. One reason for reflected energy is a poor impedance match between a high power amplifier HPA1, HPA2, HPA3, HPA4, HPA5, HPA6 and HPA7 and a corresponding channel filter. Electromagnetic energy may also be reflected back from the device to which the system 390 is connected with, which may be, for example, an improperly deployed antenna. Alternatively, one of the switches sw1, sw2, sw3, sw4 or sw5 may be incorrectly set so that a signal from a high power amplifier is directed back to the high power amplifier. Another possibility is that the energy from one of the high power amplifiers could be directed to another high power amplifier as would be the case in the configuration shown if HPA6 were turned on. In addition, the signal from a high power amplifier must match the frequency of the channel filter to which it is connected or else the channel filter will reflect the signal back to the high power amplifier.

The space environment poses a number of technical challenges for the terminations that are used in the isolators iso1, iso2, iso3, iso4, iso5, iso6 and iso7. Firstly, since there is a vacuum in space, heat dissipation through heat convection is not possible and heat radiation is ineffective which leaves only heat conduction as a means for dissipating heat from the termination. Secondly, mass is an important issue in spacecraft equipment since it is extremely expensive to launch heavy items into space. Hence the termination must be made small and light. Thirdly, the layout of the satellite is typically very compact in order to keep size and mass low. Consequently, the termination must be designed to accommodate installation and to prevent interference with adjacent electrical components. Furthermore, a termination is often remotely located from the source of electromagnetic energy for thermal reasons and coaxial cables are used to deliver the electromagnetic energy to the termination. Hence a coaxial interface to the termination is required. Each of these issues has been addressed by the various terminations of the present invention.

Figure 15A:
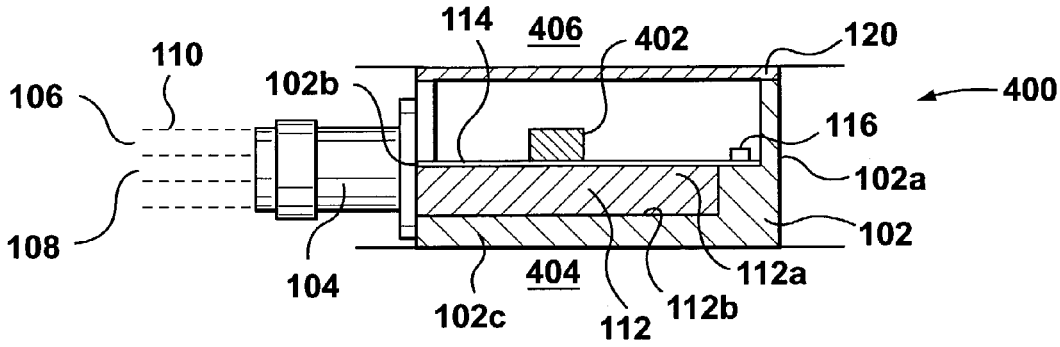
FIG. 15*a* is a partial cross-sectional side view of an alternative embodiment of a termination employing an additional dielectric block to alter frequency performance.

The terminations illustrated and described herein may be altered to allow for tuning the frequency range of operation by applying tuning screws or raised bosses to the lid of the termination, by machining grooves into the lid, or by mounting dielectric blocks on top of the conductor. This latter option is shown for termination 400 in FIG. 15*a*. If a dielectric block is mounted on top of the conductor 114, the position and size of the dielectric block as well as its dielectric constant may be varied to alter the frequency performance of the termination 400. The conductor 114 has first and second surfaces wherein the first surface is disposed adjacent to the absorber 112. The termination 400 further has at least one dielectric portion 402 that is disposed adjacent to the second surface of the conductor 402 for providing a tuning mechanism for altering the microwave performance of the termination 400. The at least one dielectric block may also provide for increased heat transfer away from the termination 400 at certain locations in a similar fashion to that for the termination 250 in which the dielectric block 258 was used to conduct heat away from the solder joint between the conductor 252 and the port 104.

Figure 15B:
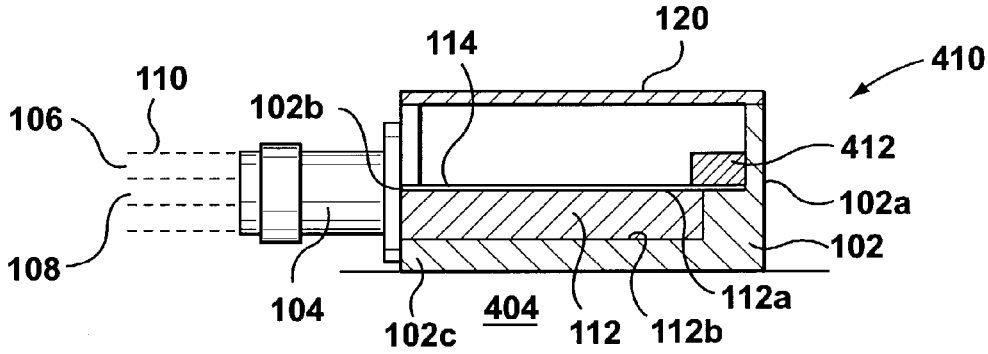
FIG. 15*b* is a partial cross-sectional side view of an alternative embodiment of a termination having an additional dielectric block.

The terminations illustrated and described herein may be modified under certain circumstances to provide for better microwave performance or for a more compact construction for the termination by the use of an additional piece of absorption material. The absorption material has good absorption characteristics. Depending on the location of the additional absorber material, the thermal characteristics of the additional absorber material may be less important. Referring to FIG. 15*b*, shown therein is a termination 410 which is identical to the termination 100 except for the addition of an additional absorber 412 on top of the conductor 114 at the back of the termination. The additional absorber 412 provides for greater absorption of electromagnetic energy, which may allow the length of the termination 410 to be shortened. Alternatively, it may allow the use of absorption materials that does not have a high thermal conductivity. The termination 410 may use composite absorbers in place of one or both of the absorbers 112 and 412. The termination 410 may also use the various conductor geometries discussed above.

Figure 15C:
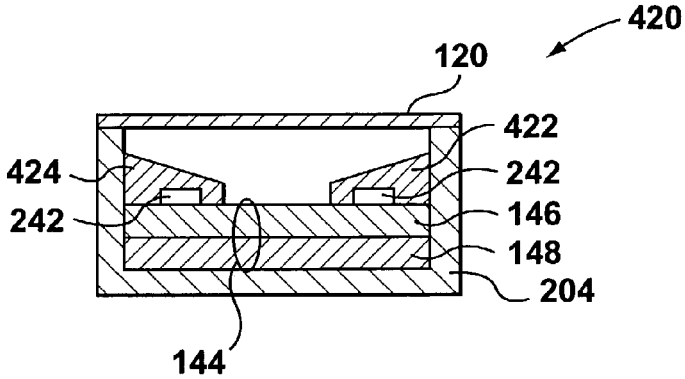
FIG. 15*c* is a cross-sectional front view of an alternative embodiment of a termination having additional dielectric blocks for increased heat conduction.

The terminations illustrated and described herein may also be modified to provide additional heat dissipation. Referring to FIG. 15*c*, shown therein is cross-sectional view of a termination 420 taken transverse to the longitudinal axis of the termination 420. The termination 420 is similar to the termination 200 except for additional dielectric portions 422 and 424. The termination 420 includes a conductor 242 having a first surface and a second surface with the first surface being disposed adjacent to the composite absorber 144. The termination 420 further has dielectric portions 422 and 424 that are disposed adjacent to the second surface of the conductor 242 and adjacent to either side of the termination 420 for providing increased heat transfer from the conductor 242 and the absorber 148. The heat is conducted down either side of the housing 204 to the bottom of the housing 204 where a heat sink may be located. The termination 420 may use an absorber 112 in place of the composite absorber 144. The termination 420 may also use the various conductor geometries discussed herein.

For each of the termination embodiments described in FIGS. 3*a*–10*c*, 13*a*–13*d* and 15*a*–15*b*, the absorber and or dielectric may be constructed from the aggregation of several portions of appropriate material, such as blocks, to form a uniform body or a body with a dimension that varies in a direction parallel to the direction of propagation of the electromagnetic energy. For instance, referring again to FIGS. 9*c* and 10*c*, the absorber 148(304) may comprise two pieces 148'(304') and 148"(304") which are assembled adjacent to one another along joint line 149(305). This allows for the use of absorption material with different absorption properties to alter the absorption and thermal profiles of the terminations. As mentioned previously, it is desirable to reduce the amount of absorption near the front of a termination where the incoming electromagnetic energy is at full strength and to increase absorption after that point to provide for a more even distribution of generated heat from absorption. Accordingly, an absorption material having a lower level of absorption may be used for the absorber piece 148'(304') and an absorption material having a higher level of absorption may be used for the absorber piece 148" (304"). In each case, the absorber pieces 148'(304') and 148"(304") are also both in contact with the bottom of the housing 204(254) to facilitate heat transfer thereto. The use of multiple absorber pieces may also be applied to the terminations 140 and 180.

Figure 16A:
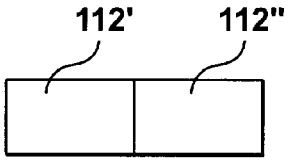
FIG. 16*a* is a side view of an alternative absorber comprising two absorber pieces.
Figure 16C:
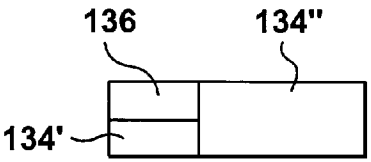
FIG. 16*c* is a side view of an alternative composite absorber comprising two absorber pieces and a single dielectric piece.
Figure 16E:
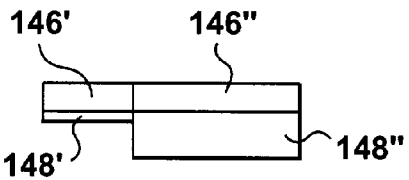
FIG. 16*e* is a side view of an alternative composite absorber having two dielectric pieces and two absorber pieces.
Figure 16B:
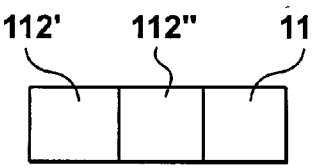
FIG. 16*b* is a side view of an alternative absorber comprising three absorber pieces.
Figure 16D:
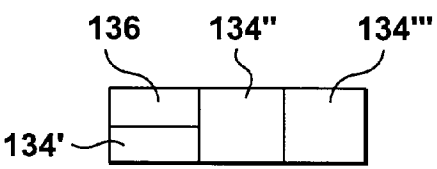
FIG. 16*d* is a side view of an alternative composite absorber comprising three absorber pieces and a single dielectric piece.
Figure 16F:
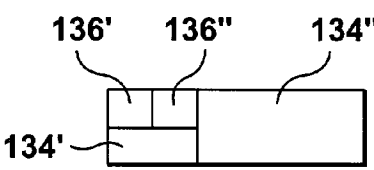
FIG. 16*f* is a side view of another alternative composite absorber having two dielectric pieces and two absorber pieces.

The use of several pieces of absorption material for constructing the absorber may also be used for terminations 100 and 122 (see FIGS. 16*a* and 16*b*) or termination 130 (see FIGS. 16*c* and 16*d*). The absorber 112(134) may comprise two absorber pieces 112'(134') and 112"(134") or alternatively three absorber pieces 112'(134'), 112"(134") and 112''' (134'''). Alternatively, the dielectric 136(146) may also comprise multiple dielectric pieces 136'(146') and 136"(146") (see FIGS. 16*e* and 16*f*). Although two or three multiple pieces have been shown herein, more than three pieces may be used. It is also not necessary for the joint line in the absorber pieces to directly correspond to the joint lines in the dielectric pieces.

The absorbers described herein may alternatively have a cross-section that varies in a direction transverse to the propagation of electromagnetic energy. For instance, beginning at a point along the longitudinal axis of the termination housing and moving in a straight horizontal line therefrom, the thickness of the absorber may be increased or decreased to either side of the termination housing. In addition, for certain applications, it may be suitable to use air for the low-loss dielectric in the composite absorber. In this case, the structural integrity of the portion of the conductor that overlies the low-loss dielectric portion of the composite absorber may become compromised. This may be mitigated by using a thin dielectric either above or below the conductor to support the conductor over the air dielectric.

Figure 17A:
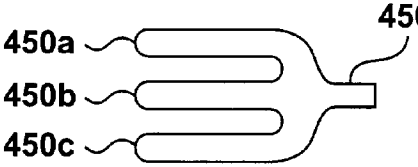
FIG. 17*a* is a top view of an alternative conductor having more than two branches.
Figure 17B:
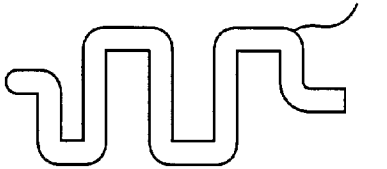
FIG. 17*b* is a top view of an alternative conductor having a meandering pattern; and, FIG. 17*c* is a top view of an alternative conductor having a spiral pattern.
Figure 17C:
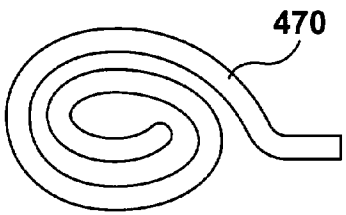

The geometries of the conductors shown herein allow for design flexibility which includes selecting certain regions of the absorber for receiving electromagnetic energy. For instance, selecting a larger width for the conductor allows for the delivery of incoming electromagnetic energy to a larger portion of the absorber for greater absorption. This allows for shortening the length of the termination. In addition, a bifurcated conductor allows for greater distribution of incoming electromagnetic energy as well as being able to withstand any stresses that may exist along the conductor, as described previously, and also being able to accommodate packaging constraints. Furthermore, conductors 142, 182, 202 and 252 are only a few examples of a conductor that may be used in terminations of the present invention. Numerous stages and numerous configurations may be used for the conductors. Conductors may also be used which have more than two branches such as conductor 450 shown in FIG. 17*a* that has three branches 450*a*, 450*b* and 450*c*. Alternatively, to provide incoming electromagnetic energy to a greater portion of the absorber a conductor having a meandering pattern such as conductor 460 (see FIG. 17*b*) or a spiral conductor 470 (see FIG. 17*c*) may be used.

Other variations for the terminations described and illustrated herein may include etching the conductor off of the absorber/composite absorber rather than having a separate conductive material that is bonded on the absorber/composite absorber to provide the conductor. Furthermore, although some conductors shown and described herein have widths that vary linearly, the width could have been varied at another rate such as exponential.

It should be understood that various modifications can be made to the preferred embodiments described and illustrated herein, without departing from the present invention, the scope of which is defined in the appended claims. In particular, the materials used and the dimensions given for,various parts are not meant to limit the scope of the present invention, but rather provide examples of working embodiments of the invention.

The invention claimed is:

1. A termination for absorbing electromagnetic energy provided by a transmission line and for transferring any resulting heat to a heat sink, said termination comprising:

a) a housing in communication with said transmission line for receiving said electromagnetic energy, said housing also being in communication with said heat sink for transferring said resulting heat thereto;

b) a conductor disposed within said housing, said conductor cooperating with said housing to provide an internal transmission line structure for confining and guiding said electromagnetic energy within said termination; and, c) an absorber having a composite structure comprising a lossy dielectric and a low-loss dielectric in at least a portion of the termination, said low-loss dielectric being disposed between said conductor and said lossy dielectric, and said lossy dielectric being disposed adjacent to said housing, said absorber being disposed within said housing and being in communication with said internal transmission line for receiving said electromagnetic energy, said absorber absorbing said electromagnetic energy according to an absorption profile of said termination, said absorber also converting the absorbed electromagnetic energy into said resulting heat and being in communication with said housing for transferring said resulting heat thereto, wherein said low-loss dielectric has a thickness adapted for increasing the spread of said electromagnetic energy through said absorber for adjusting the absorption profile of said termination and, wherein said conductor has a narrow width in a first region where said incoming electromagnetic energy is at full strength for reducing the absorption in said first region and a greater width in a second region where said incoming electromagnetic energy is reduced, due to absorption in the first region, for increasing the amount of absorption in said second region.

2. The termination of claim 1, wherein said low-loss dielectric has a thickness selected to improve impedance matching between said termination and said transmission line.

3. The termination of claim 1, wherein said low-loss dielectric comprises multiple pieces of low-loss dielectric material.

4. The termination of claim 1, wherein said low-loss dielectric has a dielectric constant lower than that of said lossy dielectric for providing an improved impedance match between said termination and said transmission line structure.

5. The termination of claim 1, wherein said conductor has at least one change in the width for providing an improved impedance match between said termination and said transmission line structure.

6. The termination of claim 1, wherein said conductor is a planar conductor and has at least one branch displaced in the plane of the conductor away from a centerline defined by the longitudinal axis of said termination for guiding said electromagnetic energy to particular regions of said absorber.

7. The termination of claim 1, wherein said absorber comprises an increase in thickness at a location for increasing absorption thereafter and said conductor has a change in width at said location for compensating for any impedance mismatch introduced by said increase in thickness of said absorber.

8. The termination of claim 1, wherein said conductor has at least one stub for adjusting termination impedance.

9. The termination of claim 1, wherein said conductor has at least one notch for adjusting termination impedance.

10. The termination of claim 1, wherein said termination further comprises at least one dielectric portion being disposed in close proximity to said conductor, wherein at least one of the position, size and dielectric constant of said at least one dielectric portion is adapted for altering termination impedance.

11. The termination of claim 1, wherein said conductor has a first surface and a second surface, said first surface being disposed adjacent to said absorber, said termination further having at least one dielectric portion disposed adjacent to said second surface and adjacent to at least one side of the housing of said termination, wherein said at least one dielectric portion provides for increased heat transfer away from said absorber.

12. The termination of claim 1, wherein said transmission line is a waveguide transmission line and said termination is connected to said waveguide transmission line via a transition region, the transition region providing at least one stepped wall for connecting said conductor to one wall of said waveguide and said transition region providing another wall for connecting said housing to another wall of said waveguide.

13. The termination of claim 1, wherein said transmission line is a stripline transmission line having a first dielectric, a second dielectric and a second conductor disposed therebetween, wherein said second conductor is connected to said conductor of said termination and said second dielectric is adjacent to said absorber and wherein, said first and second dielectrics have geometries and material properties for providing an impedance match to said termination.

14. The termination of claim 1, wherein said transmission line is a microstrip transmission line having a dielectric and a second conductor adjacent to said dielectric, wherein said second conductor is connected to said conductor of said termination and said dielectric is adjacent to said absorber, said dielectric having a geometry and material properties for providing an impedance match to said termination.

15. The termination of claim 1, wherein said absorber comprises multiple absorber pieces, each of said absorber pieces being in thermal communication with said housing.

16. The termination of claim 15, wherein said absorber pieces are made from different lossy dielectric materials to adjust at least one of the absorption profile of said termination and the termination impedance.

17. The termination of claim 1, wherein said conductor comprises a plurality of branches spaced apart from one another for increasing the distribution of said electromagnetic energy through said absorber for adjusting the absorption profile of said termination.

18. The termination of claim 17, wherein at least one of said branches has a change in width for reducing impedance mismatch between said termination and said transmission line.

19. The termination of claim 1, wherein said transmission line is a coaxial transmission line and said termination comprises a coaxial connector attached to said housing and said conductor for providing a connection between said termination and said coaxial transmission line.

20. The termination of claim 19, wherein said coaxial connector has a first longitudinal axis and said termination has a second longitudinal axis, said first and second axes being parallel to one another.

21. The termination of 19, wherein said coaxial connector has a first longitudinal axis and said termination has a second longitudinal axis, said first and second axes being perpendicular to one another.

22. The termination of claim 1, wherein said lossy dielectric is a ferrite.

23. The termination of claim 22, wherein said ferrite has a thermal conductivity of at least approximately 3.2 W/m·K.

24. The termination of claim 22, wherein said ferrite has a Curie temperature of at least approximately 300° C.

25. The termination of claim 22, wherein said ferrite has a dielectric constant of at least approximately 12.

26. The termination of claim 22, wherein said ferrite is sintered.

27. The termination of claim 22, wherein said ferrite is a Ni-Zn ferrite.

28. The termination of claim 27, wherein said Ni-Zn ferrite has approximately a 20% Ni composition and an 80% Zn composition.

29. The termination of claim 22, wherein said ferrite is a lithium-based ferrite.

30. The termination of claim 29, wherein said lithium-based ferrite has a Curie temperature of at least 300° C.

31. A termination for absorbing electromagnetic energy provided by a transmission line and for transferring any resulting heat to a heat sink, said termination comprising:

a) a housing in communication with said transmission line for receiving said electromagnetic energy, said housing also being in communication with said heat sink for transferring said resulting heat thereto;

b) a conductor disposed within said housing, said conductor cooperating with said housing to provide an internal transmission line structure for confining and guiding said electromagnetic energy within said termination; and, c) a composite absorber disposed within said housing and being in communication with said internal transmission line for receiving said electromagnetic energy, said composite absorber absorbing said electromagnetic energy according to an absorption profile of said termination, said composite absorber also converting the absorbed electromagnetic energy into said resulting heat and being in communication with said housing for transferring said resulting heat thereto, wherein, said composite absorber comprises a lossy dielectric and a low-loss dielectric in at least a portion of the termination, said low-loss dielectric being disposed between said conductor and said lossy dielectric, and said lossy dielectric being disposed adjacent to said housing, said low-loss dielectric being adapted for increasing the spread of said electromagnetic energy through said composite absorber in a direction transverse to the propagation of the electromagnetic energy for adjusting the absorption profile of said termination, and wherein the conductor is planar and has at least one branch displaced in the plane of the conductor away from a centerline defined by the longitudinal axis of said termination for guiding said electromagnetic energy to particular regions of said absorber.

32. The termination of claim 31, wherein said low-loss dielectric has a thickness selected to improve impedance matching between said termination and said transmission line.

33. The termination of claim 31, wherein said low-loss dielectric comprises multiple pieces of low-loss dielectric material.

34. The termination of claim 31, wherein said low-loss dielectric has a dielectric constant selected to be lower than that of said lossy dielectric for providing an improved impedance match between said termination and said transmission line structure.

35. The termination of claim 31, wherein said conductor has at least one change in the width for providing an improved impedance match between said termination and said transmission line structure.

36. The termination of claim 31, wherein said conductor includes an increase in width for increasing the distribution of said electromagnetic energy through said absorber for increasing absorption of said electromagnetic energy.

37. The termination of claim 31, wherein said composite absorber comprises an increase in thickness at a location for increasing absorption thereafter and said conductor has a change in width at said location for compensating for any impedance mis-match introduced by said increase in thickness of said composite absorber.

38. The termination of claim 31, wherein said conductor has at least one stub for adjusting termination impedance.

39. The termination of claim 31, wherein said conductor has at least one notch for adjusting termination impedance.

40. The termination of claim 31, wherein said termination further comprises at least one dielectric portion being disposed in the vicinity of said conductor, wherein at least one of the position, size and dielectric constant of said at least one dielectric portion is adapted for altering the impedance of said termination.

41. The termination of claim 31, wherein said conductor has a first surface and a second surface, said first surface being disposed adjacent to said absorber, said termination further having at least one dielectric portion disposed adjacent to said second surface and adjacent to at least one side of the housing of said termination, wherein said at least one dielectric portion provides for increased heat transfer away from said absorber.

42. The termination of claim 31, wherein said transmission line is a waveguide transmission line and said termination is connected to said waveguide transmission line via a transition region, the transition region providing at least one stepped wall for connecting said conductor to one wall of said waveguide and the transition region providing another wall for connecting said housing to another wall of said waveguide.

43. The termination of claim 31, wherein said transmission line is a stripline transmission line having a first dielectric, a second dielectric and a second conductor disposed therebetween, wherein said second conductor is connected to said conductor of said termination and said second dielectric is adjacent to said absorber and wherein, said first and second dielectrics have geometries and material properties for providing an impedance match to said termination.

44. The termination of claim 31, wherein said transmission line is a microstrip transmission line having a dielectric and a second conductor adjacent to said dielectric, wherein said second conductor is connected to said conductor of said termination and said dielectric is adjacent to said absorber, said dielectric having a geometry and material properties for providing an impedance match to said termination.

45. The termination of claim 31, wherein said composite absorber comprises multiple absorber pieces, each of said absorber pieces being in thermal communication with said housing.

46. The termination of claim 45, wherein said absorber pieces are made from different lossy dielectric materials to adjust at least one of the absorption profile of said termination and termination impedance.

47. The termination of claim 31, wherein said conductor comprises a plurality of branches spaced apart from one another for guiding said electromagnetic energy through a greater portion of said absorber for adjusting the absorption profile of said termination.

48. The termination of claim 47, wherein at least one of said branches has a change in width for reducing impedance mismatch between said termination and said transmission line.

49. The termination of claim 31, wherein said transmission line is a coaxial transmission line and said termination comprises a coaxial connector attached to said housing and said conductor for providing a connection between said termination and said coaxial transmission line.

50. The termination of 49, wherein said coaxial connector has a first longitudinal axis and said termination has a second longitudinal axis, said first and second axes being parallel to one another.

51. The termination of 49, wherein said coaxial connector has a first longitudinal axis and said termination has a second longitudinal axis, said first and second axes being perpendicular to one another.

52. The termination of claim 31, wherein said lossy dielectric is a ferrite.

53. The termination of claim 52, wherein said ferrite has a thermal conductivity of at least approximately 3.2 W/m·K.

54. The termination of claim 52, wherein said ferrite has a Curie temperature of at least approximately 300° C.

55. The termination of claim 52, wherein said ferrite has a dielectric constant of at least approximately 12.

56. The termination of claim 52, wherein said ferrite is sintered.

57. The termination of claim 52, wherein said ferrite is a Ni-Zn ferrite.

58. The termination of claim 57, wherein said Ni-Zn ferrite has approximately a 20% Ni composition and an 80% Zn composition.

59. The termination of claim 52, wherein said ferrite is a lithium-based ferrite.

60. The termination of claim 59, wherein said lithium-based ferrite has a Curie temperature of at least 300° C.

61. A termination for absorbing electromagnetic energy provided by a transmission line and for transferring any resulting heat to a heat sink, said termination comprising:

a) a housing in communication with said transmission line for receiving said electromagnetic energy, said housing also being in communication with said heat sink for transferring said resulting heat thereto;

b) a conductor disposed within said housing, said conductor cooperating with said housing to provide an internal transmission line structure for confining and guiding said electromagnetic energy within said termination; and, c) an absorber including a composite structure comprising a lossy dielectric and a low-loss dielectric in at least a portion of the termination, said low-loss dielectric being disposed between said conductor and said lossy dielectric, and said lossy dielectric being disposed adjacent to said housing, said absorber being disposed within said housing and being in communication with said internal transmission line for receiving said electromagnetic energy, said absorber absorbing said electromagnetic energy according to an absorption profile of said termination, said absorber also converting the absorbed electromagnetic energy into said resulting heat and being in communication with said housing for transferring said resulting heat thereto, said low-loss dielectric being adapted for increasing the spread of said electromagnetic energy through said absorber and, wherein, at least a portion of said conductor has at least two branches spaced apart from one another for increasing the spread of said electromagnetic energy through said absorber for adjusting the absorption profile of said termination.

62. The termination of claim 61, wherein said low-loss dielectric has a thickness adapted for improving impedance matching between said termination and said transmission line.

63. The termination of claim 61, wherein said low-loss dielectric has a dielectric constant lower than that of said lossy dielectric for providing an improved impedance match between said termination and said transmission line structure.

64. The termination of claim 61, wherein said conductor has at least one change in width for providing an improved impedance match between said termination and said transmission line structure.

65. The termination of claim 61, wherein said conductor is planar and has at least one branch displaced in the plane of the conductor away from a centerline defined by the longitudinal axis of said termination for guiding said electromagnetic energy to particular regions of said absorber.

66. The termination of claim 61, wherein at least one of said branches has a change in width for reducing impedance mismatch between said termination and said transmission line.

67. The termination of claim 61, wherein said absorber comprises an increase in thickness at a location for increasing absorption thereafter and said conductor has a change in width at said location for compensating for any impedance mis-match introduced by said increase in thickness of said absorber.

68. The termination of claim 61, wherein said conductor has at least one stub for adjusting termination impedance.

69. The termination of claim 61, wherein said conductor has at least one notch for adjusting termination impedance.

70. The termination of claim 61, wherein said termination further comprises at least one dielectric portion being disposed in close proximity to said conductor, wherein at least one of the position, size and dielectric constant of said at least one dielectric portion is adapted for altering termination impedance.

71. The termination of claim 61, wherein said conductor has a first surface and a second surface, said first surface being disposed adjacent to said absorber, said termination further having at least one dielectric portion disposed adjacent to said second surface and adjacent to at least one side of the housing of said termination, wherein said at least one dielectric portion provides for increased heat transfer away from said absorber.

72. The termination of claim 61, wherein said transmission line is a waveguide transmission line and said termination is connected to said waveguide transmission line via a transition region, the transition region providing at least one stepped wall for connecting said conductor to one wall of said waveguide and said transition region providing another wall for connecting said housing to another wall of said waveguide.

73. The termination of claim 61, wherein said transmission line is a stripline transmission line having a first dielectric, a second dielectric and a second conductor disposed therebetween, wherein said second conductor is connected to said conductor of said termination and said second dielectric is adjacent to said absorber and wherein, said first and second dielectrics having geometries and material properties for providing an impedance match to said termination.

74. The termination of claim 61, wherein said absorber comprises multiple absorber pieces, each of said absorber pieces being in thermal communication with said housing.

75. The termination of claim 74, wherein said absorber pieces are made from different lossy dielectric materials to adjust at least one of the absorption profile of said termination and the termination impedance.

76. The termination of claim 61, wherein said low-loss dielectric comprises multiple pieces of low-loss dielectric material.

77. The termination of claim 76, wherein said transmission line is a microstrip transmission line having a dielectric and a second conductor adjacent to said dielectric, wherein said second conductor is connected to said conductor of said termination and said dielectric is adjacent to said absorber, said dielectric having geometry and material properties for providing an impedance match to said termination.

78. The termination of claim 61, wherein said transmission line is a coaxial transmission line and said termination comprises a coaxial connector attached to said housing and said conductor for providing a connection between said termination and said coaxial transmission line.

79. The termination of claim 78, wherein said coaxial connector has a first longitudinal axis and said termination has a second longitudinal axis, said first and second axes being parallel to one another.

80. The termination of claim 78, wherein said coaxial connector has a first longitudinal axis and said termination has a second longitudinal axis, said first and second axes being perpendicular to one another.

81. The termination of claim 61, wherein said lossy dielectric is a ferrite.

82. The termination of claim 81, wherein said ferrite has a thermal conductivity of at least approximately 3.2 W/m·K.

83. The termination of claim 81, wherein said ferrite has a Curie temperature of at least approximately 300° C.

84. The termination of claim 81, wherein said ferrite has a dielectric constant of at least approximately 12.

85. The termination of claim 81, wherein said ferrite is sintered.

86. The termination of claim 81, wherein said ferrite is a Ni-Zn ferrite.

87. The termination of 86, wherein said Ni-Zn ferrite has approximately a 20% Ni composition and an 80% Zn composition.

88. The termination of claim 81, wherein said ferrite is a lithium-based ferrite.

89. The termination of claim 88, wherein said lithium-based ferrite has a Curie temperature of at least 300° C.

90. A termination for absorbing electromagnetic energy provided by a transmission line and for transferring any resulting heat to a heat sink, said termination comprising:

a) a housing in communication with said transmission line for receiving said electromagnetic energy, said housing also being in communication with said heat sink for transferring said resulting heat thereto;

b) a conductor disposed within said housing, said conductor cooperating with said housing to provide an internal transmission line structure for confining and guiding said electromagnetic energy within said termination; and, c) a composite absorber disposed within said housing and being in communication with said internal transmission line for receiving said electromagnetic energy, said composite absorber absorbing said electromagnetic energy according to an absorption profile of said termination, said composite absorber also converting the absorbed electromagnetic energy into said resulting heat and being in communication with said housing for transferring said resulting heat thereto, wherein, said composite absorber comprises a lossy dielectric and a low-loss dielectric in at least a portion of the termination, said low-loss dielectric being disposed between said conductor and said lossy dielectric, and said lossy dielectric being disposed adjacent to said housing, said low-loss dielectric being adapted for increasing the spread of said electromagnetic energy through said composite absorber in a direction transverse to the propagation of the electromagnetic energy for adjusting the absorption profile of said termination, and wherein said composite absorber comprises an increase in thickness at a location for increasing absorption thereafter and said conductor has a change in width at said location for compensating for any impedance mis-match introduced by said increase in thickness of said composite absorber.

* * * * *

UNITED STATES PATENT AND TRADEMARK OFFICE

CERTIFICATE OF CORRECTION

PATENT NO. : 7,042,305 B2
APPLICATION NO. : 10/323825
DATED : May 9, 2006
INVENTOR(S) : Gordon Thomas Wray It is certified that error appears in the above-identified patent and that said Letters Patent is hereby corrected as shown below:

Column 14, line 4, the name "Wilhelm Von Aviock" has been changed to --Wilhelm Von Avlock--, so that the line reads --edited by Wilhelm Von Avlock provides insight into the--.

Column 2, line 2, the phrase "that engage apertures 278 inner ridge" has been changed to --that engage aperture 278 located on an inner ridge--, so that the line reads --fasteners 276 that engage apertures 278 located on an inner ridge 280 within--.

Column 23, line 27, the phrase "conductor 338 selecting materials" has been changed to --conductor 338 as well as by selecting materials--, so that the line reads --conductor 338 as well as by selecting materials having a desired dielectric--.

Signed and Sealed this

First Day of September, 2009

David J. Kappos

David J. Kappos
*Director of the United States Patent and Trademark Office*